US005707789A

United States Patent [19]

Takemura

[11] Patent Number: 5,707,789

[45] Date of Patent: Jan. 13, 1998

[54] SOLID PROCESSING COMPOSITION FOR SILVER HALIDE PHOTOGRAPHIC LIGHT-SENSITIVE MATERIALS

[75] Inventor: Koji Takemura, Hino, Japan

[73] Assignee: Konica Corporation, Tokyo, Japan

[21] Appl. No.: 704,147

[22] Filed: Aug. 28, 1996

Related U.S. Application Data

[63] Continuation of Ser. No. 429,246, Apr. 25, 1995, abandoned.

[30] Foreign Application Priority Data

Apr. 28, 1994 [JP] Japan ..... 6-091985

[51] Int. Cl.[6] ..... G03C 7/30

[52] U.S. Cl. ..... 430/463; 430/372; 430/428; 430/429

[58] Field of Search ..... 430/372, 428, 430/429, 458, 463, 465

[56] References Cited

U.S. PATENT DOCUMENTS

| | | | |
|---|---|---|---|
| 3,095,302 | 6/1963 | Jeffreys et al. | 430/17 |
| 4,816,384 | 3/1989 | Fruge et al. | 430/465 |
| 5,188,925 | 2/1993 | Hagiwara et al. | 430/372 |
| 5,217,852 | 6/1993 | Morigaki et al. | 430/428 |
| 5,336,588 | 8/1994 | Ueda | 430/465 |
| 5,409,805 | 4/1995 | Haraguchi et al. | 430/465 |
| 5,415,979 | 5/1995 | Takemura et al. | 430/429 |
| 5,424,177 | 6/1995 | Kobayashi et al. | 430/429 |
| 5,480,768 | 1/1996 | Ishida et al. | 430/393 |
| 5,587,277 | 12/1996 | Yamashita et al. | 430/458 |

FOREIGN PATENT DOCUMENTS

| | | |
|---|---|---|
| 0 636 930 A1 | 2/1995 | European Pat. Off. . |
| 619093 | of 1994 | Japan . |
| 635150 | of 1994 | Japan . |

*Primary Examiner*—Hoa Van Le
*Attorney, Agent, or Firm*—Frishauf, Holtz, Goodman, Langer & Chick, P.C.

[57] ABSTRACT

A solid processing composition for a silver halide photographic light-sensitive material is disclosed which comprises a saccharide and a compound selected from the group consisting of a hexamethylenetetramine compound and compounds represented by the following Formulas (I), (G), (H-1), (H-3) and (H-3):

Formulas (I)

Formula (G)

FORMULA (H-1)

FORMULA (H-1)

FORMULA (H-3)

8 Claims, No Drawings

SOLID PROCESSING COMPOSITION FOR SILVER HALIDE PHOTOGRAPHIC LIGHT-SENSITIVE MATERIALS

This application is a continuation of application Ser. No. 08/429,246, filed Apr. 25, 1995 now abandoned.

FIELD OF THE INVENTION

The invention relates to a solid processing composition (hereinafter referred to as a solid processing composition) for a silver halide photographic light-sensitive material (hereinafter referred to as a light sensitive material), and particularly to a solid processing composition which has excellent storage stability and handling properties.

BACKGROUND OF THE INVENTION

When a film is processed with a processing solution, it is well known that a compound represented by Formula (I), (G), (H-1), (H-2) or (H-3) (hereinafter also referred to as a formaldehyde alternative) or a hexamethylenetetramine compound (hereinafter also referred to as a formaldehyde alternative) are used in a stabilizing solution in view of image stability. Japanese Patent O.P.I. Publication Nos. 6-35150/1994 and 6-19093/1994 disclose a technique to solidify a processing composition for a stabilizer containing the above described compounds.

However, the above proposed technique has not been found to be satisfactory, and it has also been found that there is a problem that the solid processing composition is colored and expanded under high temperature and humidity conditions or after a long term storage at an ordinary temperature.

It has also been found that even when a vessel containing the solid processing composition is tightly sealed against humidity, it is difficult to prevent the coloration and expansion cannot be prevented under high temperature and humidity circumstances such as Southeast Asia, Africa or Japanese summers.

There is a new problem in that some of the above described formaldehyde alternatives have subliming property and produce needle crystals on its surface at high temperature due to the strong dependence on temperature, resulting in aggregation and blocking in granules and resulting in failure during supplying due to the rough surface in tablets. Another problem is that when customers open a package containing the solid processing composition, the crystals produced on the surface float freely.

The formaldehyde alternative is colored due to oxidation, polymerization or decomposition under severe conditions, and indicates that it cannot give a stable stabilizer.

The present inventors have found that simply solidifying a processing composition for a stabilizer containing the above aldehyde alternative has the following problems.

The solidified composition containing the above compound causes no problem immediately after its manufacture; however, it expands and colors under high temperature or after long-term storage at an ordinary temperature even when tightly closed, if it contains a slight amount of water or absorbs moisture from the atmosphere, resulting in a product of no commercial value. When the composition is in a form of granules, granules adhere, resulting in blocking.

When the above described formaldehyde alternatives are stored for a long time in admixture with other compounds in a solid processing composition, water present in the solid processing composition or atmospheric moisture reacts with the formaldehyde alternatives and causes a hydrolysis reaction. As a result, formaldehyde or other aldehyde compounds are produced and scatter around. This phenomenon is noticeable particularly when stored for a long time at a high temperature area such as in the tropics. There is another problem in view of working circumstances that, opening a package containing a solid processing composition comprising a formaldehyde alternative, unpleasant and harmful odors peculiar to aldehydes are produced. Further, it has been found that she solid processing composition is not sufficient to block an active site of a magenta coupler, and, when a light sensitive material processed with a stabilizer containing this solid processing composition is stored in a dry state, there occurs the problem that the magenta dye density is reduced.

SUMMARY OF THE INVENTION

Accordingly, an object of the invention is to provide a solid processing composition of the invention for a silver halide photographic light-sensitive material which shows stable and excellent properties, preventing coloration, expansion and occurrence of needle crystals or odor in a solid stabilizing composition under high temperature and humidity conditions and preventing density reduction of a color image in a processed light sensitive material.

DETAILED DESCRIPTION OF THE INVENTION

The above object of the invention can be attained by the following methods:

(1) A solid processing composition for a silver halide photographic light-sensitive material, wherein the composition comprises at least one saccharide and at least one of compounds selected from the group consisting of a hexamethylenetetramine compound and compounds represented by the following Formulas (I), (G) and (H-1) through (H-3):

Formula (I)

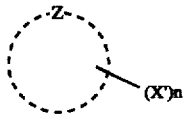

wherein Z represents an atomic group necessary to form a hydrocarbon ring or a heterocyclic ring; X' represents an aldehyde group,

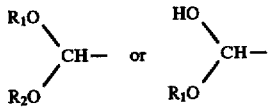

wherein $R_1$ and $R_2$ independently represent a lower alkyl group; and n is an integer of 1 to 4, Formula (G)

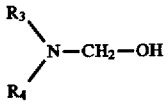

wherein $R_3$ and $R_4$ may be the same or different and independently represent a hydrogen atom or a substituent, provided that $R_3$ and $R_4$ may combine each other to form a ring containing one or two nitrogen atoms,

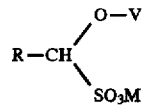

Formula (H-1)

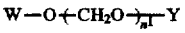

Formula (H-2)

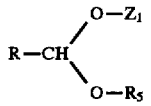

Formula (H-3)

wherein R represents a hydrogen atom or an aliphatic hydrocarbon group; V represents a group capable of being released on hydrolysis; W and Y independently represent a hydrogen atom or a group capable of being released on hydrolysis; $n^1$ represents an integer of 1 to 10; $Z_1$ represents a hydrogen atom, an aliphatic hydrocarbon group, an aryl group or the other group capable of being released on hydrolysis; $R_5$ represents an aliphatic hydrocarbon group or an aryl group, provided that $Z_1$ may combine with $R_5$ to form a ring; and M represents a hydrogen atom, an ammonium group, an alkali metal atom or an organic ammonium group.

(2) The solid processing composition for a silver halide photographic light-sensitive material of (1) above, wherein the saccharide content is 0.1 to 50 weight %.

(3) A solid processing composition for a silver halide photographic light-sensitive material, wherein the composition comprises at least one of compounds selected from the group consisting of a hexamethylenetetramine compound and compounds represented by the above Formulas (I), (G) and (H-1) through (H-3) and at least one of compounds selected from the group consisting of compounds represented by the following Formulas (K-I) through (K-IX):

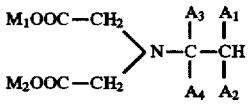

Formula (K-I)

wherein $A_1$ to $A_4$ may be the same with or the different from each other and represent each a hydrogen atom, a hydroxy group, —COOM', —$PO_3(M_1)_2$, —$CH_2COOM_2$, —$CH_2OH$ or a lower alkyl group which may have a substituent, provided that at least one of $A_1$ to $A_4$ represents —COOM', —$PO_3(M_1)_2$ or —$CH_2COOM_2$; and M', $M_1$ and $M_2$ represent each a hydrogen atom, an ammonium group, an alkali metal atom or an organic ammonium group,

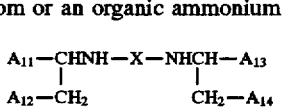

Formula (K-II)

wherein $A_{11}$ to $A_{14}$ may be the same with or the different from each other and represent each —$CH_2OH$, —$COOM^3$ or —$PO_3(M_4)_2$; $M^3$ and $M^4$ represent each a hydrogen atom, an ammonium group, an alkali metal atom or an organic ammonium group; X represents an alkylene group having 2 to 6 carbon atoms or —$(B_1O)_{n^2}$—$B_2$— in which $n^2$ is an integer of 1 to 8 and $B_1$ and $B_2$ may be the same with or the different from each other and represent each an alkylene group having 1 to 5 carbon atoms,

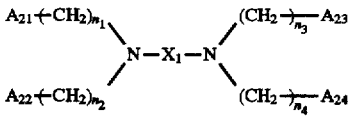

Formula (K-III)

wherein $A_{21}$ to $A_{24}$ may be the same with or the different from each other and represent each —$CH_2OH$, —$COOM_5$, —$N[(CH_2)_{n_5}COOH][(CH_2)_{n_6}COOH]$ or —$PO_3(M_6)_2$; $M_5$ and $M_6$ represent each a hydrogen atom, an ammonium group, an alkali metal atom or an organic ammonium group; $X_1$ represents a straight-chained or branched alkylene group having 2 to 6 carbon atoms, a saturated or unsaturated organic ring or —$(B_{11}O)_{n_7}$—$B_{12}$— in which $n_7$ represents an integer of 1 to 8, and $B_{11}$ and $B_{12}$ may be the same as or different from each other and represent each an alkylene group; and $n_1$ through $n_6$ represent an integer of 1 to 4 and may be the same as or different from each other,

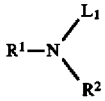

Formula (K-IV)

wherein $R^1$ and $R^2$ represent each a hydrogen atom, a substituted or unsubstituted alkyl or aryl group; $L_1$ represents,

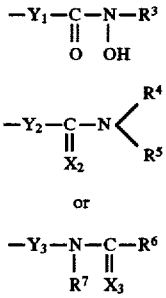

wherein $Y_1$ through $Y_3$ represent each an alkylene or arylene group; $X_2$ and $X_3$ represent each an oxygen atom or a sulfur atom; and $R^3$ to $R^7$ represent each a hydrogen atom, an alkyl group or an aryl group,

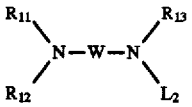

Formula (K-V)

wherein $R_{11}$ through $R_{13}$ represent each a hydrogen atom, a substituted or unsubstituted alkyl or aryl group; $L_2$ is the same as those denoted in $L_1$ of Formula (K-IV); and W represents a divalent linking group,

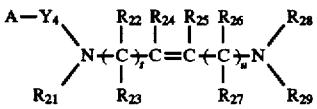

Formula (K-VI)

wherein $R_{21}$ through $R_{23}$ and $R_{26}$ through $R_{29}$ represent each a hydrogen atom or a substituted or unsubstituted alkyl or aryl group; $R_{24}$ and $R_{25}$ represent each a hydrogen atom, a halogen atom, a cyano group, a nitro group, an acyl group, a sulfamoyl group, a carbamoyl group, an alkoxycarbonyl group, an aryloxycarbonyl group, a sulfonyl group, a sulfinyl group or a substituted or unsubstituted alkyl or aryl group, provided that $R_{24}$ and $R_{25}$ may combine to form a 5-membered or 6-membered ring; A represents a carboxy group, a phosphono group, a sulfo group, a hydroxy group or an alkyl metal salt or ammonium salt thereof; $Y_4$ represents an alkylene group or an arylene group which may have a substituent; and t and u are each an integer of 0 or 1, Formula (K-VII)

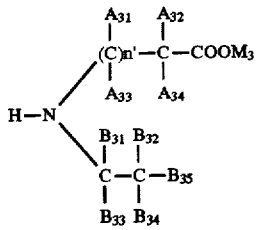

wherein n' is an integer of 1 to 3; $A_{31}$ through $A_{34}$ and $B_{31}$ through $B_{35}$ represent each —H, —OH, $—C_{n''}H_{2n''+1}$, or $—(CH_2)_{m_1}X_5$ in which n" and $m_1$ are an integer of 1 to 3 and 0 to 3, respectively, and $X_5$ represents $—COOM_3$ (in which $M_3$ represents a hydrogen atom, an ammonium group or an alkali metal atom), $—NH_2$ or —OH, provided that $B_{31}$ through $B_{35}$ are not simultaneously hydrogen atoms, Formula (K-VIII)

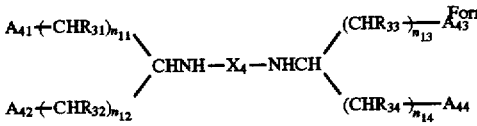

wherein $A_{41}$ to $A_{44}$ may be the same with or the different from each other and represent each $—COOM_{21}$, —OH, $—PO_3(M_{21})(M_{22})$ or $—CONH_2$; $M_{21}$ and $M_{22}$ represent each a hydrogen atom, an alkali metal atom or an ammonium group; $n_{11}$ through $n_{14}$ represent each 0, 1 or 2; $R_{31}$ through $R_{34}$ represent each a hydrogen atom, a lower alkyl group or a hydroxy group, provided that when $n_{11}+n_{12}=1$ and $n_{13}+n_{14}=1$, none of $R_{31}$ through $R_{34}$ are hydrogen atoms;

$X_4$ represents a substituted or unsubstituted alkylene group having 2 to 6 carbon atoms or $—(B_{21}O)_{m_{11}}—B_{22}—$ in which $m_{11}$ is an integer of 1 to 4 and $B_{21}$ and $B_{22}$ may be the same with or the different from each other and represent each a substituted or unsubstituted alkylene group having 1 to 5 carbon atoms, Formula (K-IX)

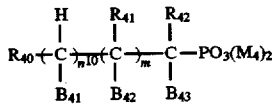

wherein $R_{40}$ through $R_{42}$ represent each a hydrogen atom, —OH, a substituted or unsubstituted lower alkyl group, in which the substituent includes, for example, —OH, $—COOM_7$ or $—PO_3(M_8)_2$; $B_{41}$ through $B_{43}$ represent each a hydrogen atom, —OH, $—COOM_7$, $—PO_3(M_8)_2$ or $—N(R')_2$ in which R' represents a hydrogen atom, an alkyl group having 1 to 5 carbon atoms or $—PO_3(M_8)_2$; $M_4$, $M_7$, and $M_8$ represent each a hydrogen atom or an alkali metal atom; and $n^{10}$ and m represent each an integer of 0 or 1.

(4) The solid processing composition for a silver halide photographic light-sensitive material of (3) above, wherein the content of at least one of compounds selected from the group consisting of compounds represented by the above Formulas (K-I) through (K-IX) is 0.1 to 50 weight %.

(5) The solid processing composition for a silver halide photographic light-sensitive material of (1) above, wherein the composition comprises at least one of compounds selected from the group consisting of compounds represented by the above Formulas (K-I) through (K-IX).

(6) The solid processing composition for a silver halide photographic light-sensitive material of (5) above, wherein the total content of a saccharide and at least one of compounds selected from the group consisting of compounds represented by the above Formulas (K-I) through (K-IX) is 0.1 to 50 weight %.

(7) The solid processing composition for a silver halide photographic light-sensitive material of (1), (2), (3), (4), (5) or (6) above, wherein Z in said Formula (I) is a benzene ring.

(8) The solid processing composition for a silver halide photographic light-sensitive material of (1), (2), (3), (4), (5), (6) or (7) above, wherein the composition is a composition for a stabilizer.

The invention will be detailed below.

The present inventors have made extensive studies, and have found surprising effects that a solid processing composition for a silver halide photographic light-sensitive material, the composition comprising at least one of compounds selected from the group consisting of a hexamethylenetetramine compound and compounds represented by the above described Formulas (I), (G) and (H-1) through (H-3) and further comprising a saccharide and/or at least one of compounds selected from the group consisting of compounds represented by the above described Formulas (K-I) through (K-IX), shows stable processability, preventing blocking of granules, coloration, expansion, occurrence on the surface of needle crystals or odor under high temperature or after long term storage and preventing density reduction after storage of a color image in a processed material.

The solid processing composition of the invention is in a form of powder, pellets, tablets or granules.

As a method for preparing tablets by compression-molding a photographic composition the conventional method is used, however, the preferable method is a method in which a powdered processing composition is granulated and the resulting granules are tableted to obtain tablets. The tablets prepared by the above have advantages that solubility and storage stability are improved and stable photographic properties are obtained as compared with those prepared by the method that the solid processing composition is only mixed and then tableted.

As for the granulating processes for forming granules or tablets, it is possible to use any of the well-known processes such as the processes of a rolling granulation, an extrusion granulation, a compression granulation, a cracking granulation, a stirring granulation, a fluidized-layer granulation and a spray-dry granulation. When the granules are mixed and compressed to obtain tablets, the average particle size of the granules is to be within the range of preferably 100 to 800 μm and more preferably 200 to 750 μm in that localization of components or so-called segregation occurs with difficulty. As to particle size distribution, not less than 60% of the granules have a deviation of preferably ±100 to 150 μm. It is preferable that when the processing composition is granulated, each component, for example, an alkali agent, a reducing agent, a bleaching agent or a preservative is individually granulated.

When the granules are compressed, the well known compressors such as a hydraulic press machine, a single tableting machine, a rotary tableting machine and a bricketing machine can be used.

The above compound represented by Formula (I) will be explained below.

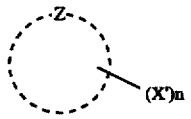

Formula (I)

In Formula (I), Z represents an atomic group necessary to form a hydrocarbon ring or a heterocyclic ring; and X' represents an aldehyde group,

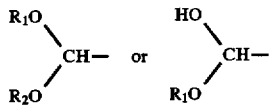

wherein $R_1$ and $R_2$ independently represent a lower alkyl group such as a methyl, ethyl, propyl or butyl group and n is an integer of 1 to 4.

In Formula (I), Z represents an atomic group necessary to form a substituted or unsubstituted hydrocarbon ring or a substituted or unsubstituted heterocyclic ring, provided that the ring may be a single or condensed ring. Z preferably represents an aromatic hydrocarbon ring or a heterocyclic ring, each having a substituent. The substituent preferably represents an aldehyde group, a hydroxy group, an alkyl group (for example, methyl, ethyl, methoxyethyl, benzyl, carboxymethyl or sulfopropyl), an aralkyl group, an alkoxy group (for example, methoxy, ethoxy, methoxyethoxy), a halogen atom, a nitro group, a sulfo group, a carboxy group, an amino group (for example, N,N-dimethylamino, N-ethylamino, N-phenylamino), a hydroxyalkyl group, an aryl group (for example, phenyl, p-methoxyphenyl ), a cyano group, an aryloxy group (for example, phenoxy, p-carboxyphenoxy), an acyloxy, a sulfonamido group, a sulfamoyl group (for example, N-ethyl sulfamoyl, N,N-dimethylsulfamoyl), a carbamoyl group (for example, carbamoyl, N-methylcarbamoyl, N,N-tetramethylenecarbamoyl) or a sulfonyl group (for example, methanesulfonyl, ethanesulfonyl, benzenesulfonyl, p-toluenesulfonyl).

The hydrocarbon ring of Z preferably is a benzene ring, and the heterocyclic ring of Z preferably is a 5- or 6-membered heterocyclic ring. The 5-membered heterocyclic ring includes thiophene, pyrrole, furan, thiazole, imidazole, succinimide, triazole, and tetrazole. The 6-membered heterocyclic ring includes pyridine, pyrimidine, triazine and thiadiazine. A condensed ring includes naphthalene, benzofuran, indole, thionaphthelene, benzotriazole and quinoline.

The preferable examples represented by Formula (I) will be shown below.

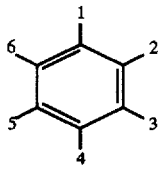

Exemplified compounds are those in which the following groups are substituted at 1–6 positions of the above Formula and are shown in the following Tables.

| No. | 1 | 2 | 3 | 4 | 5 | 6 |
|---|---|---|---|---|---|---|
| (I-1) | −CHO | H | H | H | H | H |
| (I-2) | −CHO | H | H | −OH | H | H |
| (I-3) | −CHO | H | −OH | H | H | H |
| (I-4) | −CHO | −OH | H | H | H | H |
| (I-5) | −CHO | −OH | H | −OH | H | H |
| (I-6) | −CHO | H | −OH | H | −OH | H |
| (I-7) | −CHO | −OH | −OH | H | H | H |
| (I-8) | −CHO | H | −CHO | H | −OH | H |
| (I-9) | −CHO | H | −CHO | H | H | −OH |
| (I-10) | −CHO | −OH | −CHO | H | H | H |
| (I-11) | −CHO | H | −CHO | H | −CHO | H |
| (I-12) | −CHO | −OH | −CHO | H | −CHO | H |
| (I-13) | $-CH(OCH_3)_2$ | H | −OH | H | H | H |
| (I-14) | $-CH(OCH_3)_2$ | H | H | −OH | H | H |
| (I-15) | $-CH(OCH_3)_2$ | H | −OH | H | −OH | H |
| (I-16) | −CHO | H | $-NO_2$ | H | H | H |
| (I-17) | −CHO | H | H | $-NO_2$ | H | H |
| (I-18) | −CHO | $-NO_2$ | H | H | H | H |
| (I-19) | −CHO | H | $-NO_2$ | H | $-NO_2$ | H |
| (I-20) | −CHO | H | H | $-OCH_3$ | H | H |
| (I-21) | −CHO | H | $-OCH_3$ | H | −OH | H |
| (I-22) | −CHO | H | −OH | $-OCH_3$ | H | H |
| (I-23) | −CHO | H | $-OCH_3$ | −OH | H | H |
| (I-24) | −CHO | H | −OH | $-OCH_3$ | −OH | H |
| (I-25) | −CHO | H | Cl | H | H | H |
| (I-26) | −CHO | H | H | Cl | H | H |
| (I-27) | −CHO | H | Cl | H | Cl | H |
| (I-28) | −CHO | H | −COOH | −COOH | H | H |
| (I-29) | −CHO | H | Br | H | H | H |
| (I-30) | −CHO | H | H | Br | H | H |
| (I-31) | −CHO | H | −OH | $-SO_3H$ | H | H |
| (I-32) | −CHO | H | H | $-NH_2$ | H | H |
| (I-33) | −CHO | H | H | $-N(CH_3)_2$ | H | H |
| (I-34) | −CHO | H | H | $-N(C_2H_5)_2$ | H | H |
| (I-35) | −CHO | H | H | $-CONH_2$ | H | H |
| (I-36) | −CHO | H | H | $-SO_2NH_2$ | H | H |
| (I-37) | −CHO | H | H | $SO_3H$ | H | H |

-continued
| No. | 1 | 2 | 3 | 4 | 5 | 6 |
|---|---|---|---|---|---|---|
| (I-38) | $-CHO$ | H | H | $-CN$ | H | H |
| (I-39) | $-CHO$ | H | H | $-COOCH_3$ | H | H |
| (I-40) | $-CHO$ | H | H | $-COOH$ | H | H |
| (I-41) | $-CHO$ | H | $-SO_3H$ | H | H | H |
| (I-42) | $-CHO$ | H | $-COOH$ | H | H | H |
| (I-43) | $-CHO$ | H | $-CN$ | H | H | H |
| (I-44) | $-CHO$ | H | $-COOCH_3$ | H | H | H |
| (I-45) | $-CHO$ | H | $-CONH_2$ | H | H | H |
| (I-46) | $-CH(OH)(OCH_3)$ | H | $-OH$ | H | H | H |
| (I-47) | $-CH(OH)(OCH_3)$ | H | H | $-OH$ | H | H |
| (I-48) | $-CHO$ | H | $-OH$ | $-CH_3$ | H | H |
| (I-49) | $-CHO$ | $-SO_3Na$ | H | H | H | H |
| (I-50) | $-CHO$ | H | $-O(CH_2)_3SO_3Na$ | H | H | H |
| (I-51) | $-CHO$ | H | $-CH_2SO_3Na$ | H | H | H |
| (I-52) | $-CHO$ | $-OH$ | $-OH$ | $-CHO$ | H | H |
(I-53)
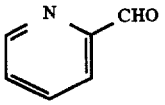
(I-54)
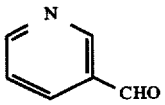
(I-55)
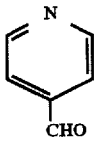
(I-56)
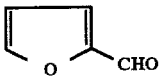
(I-57)
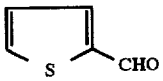
(I-58)
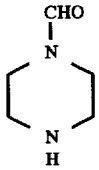
(I-59)
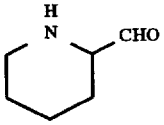
(I-60)
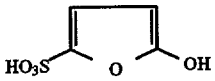
(I-61)
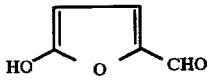

-continued
| No. | 1 | 2 | 3 | 4 | 5 | 6 |
|---|---|---|---|---|---|---|
| (I-62) | 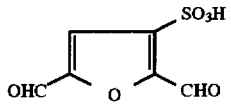 | | | | | |
| (I-63) | 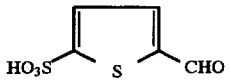 | | | | | |
| (I-64) | 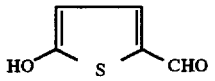 | | | | | |
| (I-65) | 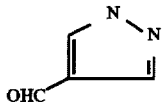 | | | | | |
| (I-66) | 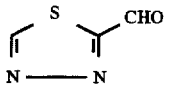 | | | | | |
| (I-67) | 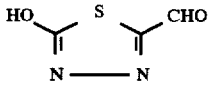 | | | | | |
| (I-68) | 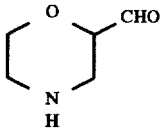 | | | | | |
| (I-69) | 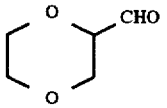 | | | | | |
| (I-70) | 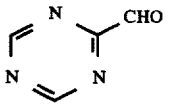 | | | | | |
| (I-71) | 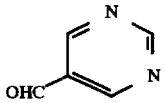 | | | | | |
| (I-72) | 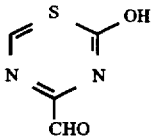 | | | | | |
| (I-73) | 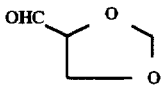 | | | | | |
| (I-74) | 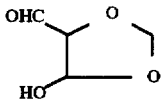 | | | | | |
| (I-75) | 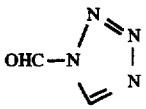 | | | | | |

-continued

| No. | 1 | 2 | 3 | 4 | 5 | 6 |
|---|---|---|---|---|---|---|
| (I-76) | 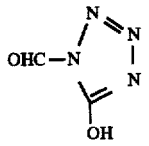 | | | | | |
| (I-77) | 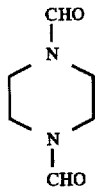 | | | | | |

Of the exemplified compounds represented by Formula (I) Compounds (I-1), (I-2), (I-3), (I-4), (I-6), (I-23), (I-24) and (I-52) are preferable, and Compound (I-3) is most preferable.

The exemplified compounds represented by Formula (I) are available on the market.

The compounds represented by Formulas (I), (G), (H-1) through (H-3) or a hexamethylenetetramine compound are contained in a stabilizer bath for a silver halide color photographic light-sensitive material. They may also be contained in a bath before a bath having bleaching capability, a bath having bleaching capability or a bath having fixing capability, in such an amount that the effects of the invention are inhibited. The content of the compound represented by Formula (I) in a stabilizer is preferably 0.05 to 20 g/liter, more preferably 0.1 to 15 g/liter, and stil more preferably 0.5 to 10 g/liter.

Next, compounds represented by Formula (G) will be explained below.

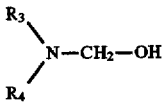

Formula (G)

In Formula (G), $R_3$ and $R_4$ may be the same or different and independently represent a hydrogen atom or a substituent, provided that $R_3$ and $R_4$ may combine each other to form a ring containing one or two nitrogen or oxygen atoms.

In Formula (G), the substituent represented by $R_3$ and $R_4$ is not limited, but includes alkyl (straight-chained or branched, preferably having 1 to 10 carbon atoms), aryl (preferably, phenyl), anilino, acylamino (alkylcarbonylamino, arylcarbonylamino), sulfonamide (alkylsulfonylamino, arylsulfonylamino), alkylthio, arylthio, alkenyl (straight-chained or branched, preferably having 2 to 11 carbon atoms) and cycloalkyl (preferably having 3 to 12 carbon atoms and more preferably having 5 to 7 carbon atoms), and further includes a halogen atom, cycloalkenyl (preferably having 3 to 12 carbon atoms and more preferably having 5 to 7 carbon atoms), alkinyl, a heterocyclic (preferably having 5 to 7 carbon atoms, concretely, 2-furyl, 2-thienyl, 2-pyrimidinyl or 2-benzothiazolyl), sulfonyl (alkylsulfonyl or arylsulfonyl), sulfinyl (alkylsulfinyl or arylsulfinyl), phosphonyl (alkylphosphonyl, alkoxyphosphonyl, arylphosphonyl or aryloxyphosphonyl), acyl (alkylcarbonyl or arylcarbonyl), carbamoyl (alkylcarbamoyl or arylcarbamoyl), sulfamoyl (alkylsulfamoyl or arylsulfamoyl), cyano, alkoxy, aryloxy, heterocyclicoxy (preferably having 5 to 7-membered ring and for example, 3,4,5,6-hydropyranyl-2-oxy or 1-phenyltetrazole-5-oxy), siloxy (trimethylsiloxy, triethylsiloxy, dimethylbutylsiloxy), acyloxy (alkylcarbonyloxy or arylcarbonyloxy), carbamoyloxy (alkylcarbamoyloxy or arylcarbamoyloxy), amino, alkylamino, imide (succinimide, 3-heptadecylsuccinimide, phthalimide or glutarimide), ureido (alkylureido or arylureido), sulfammoylamino (alkylsulfamoylamino or arylsulfamoylamino), alkoxycarbonylamino, aryloxycarbonylamino, a heterocyclicthio (preferably having 5 to 7-membered ring, for example, 2-pyridylthio, 2-benzothiazolylthio or 2,4-diphenoxy-1,3,5-triazol-6-thio), a spyro compound residue (spyro [3.3] heptane-1-yl) or bridged hydrocarbon residue (bicyclo [2.2.1] heptane-1-yl, tricyclo [3.3.1.1] decane-1-yl or 7,7-dimethylbicyclo [2.2.1] heptane-1-yl).

The group represented by $R_3$ and $R_4$ further has a substituent, and the substituent is preferably a hydroxy group, a carboxyl group, a sulfonic acid group, a phosphoric acid group, an amino group, an acid group or an alkoxy group.

The examples represented by Formula (G) will be shown below.

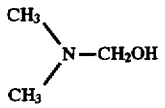

G-1

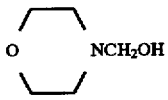

G-2

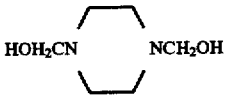

G-3

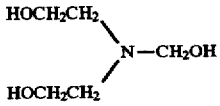

G-4

-continued

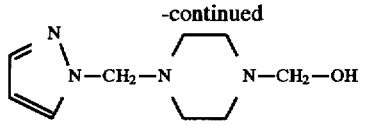

G-5

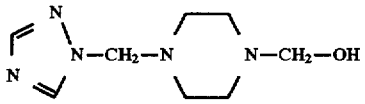

G-6

Besides the above compounds, the compounds represented by Formula (G) include compounds (A-1) through (A-76) described on pages 10–20 in Japanese Patent O.P.I. Publication No. 4-359249/1992, compounds (X-1) through (X-76) described on pages 14–23 in Japanese Patent O.P.I. Publication No. 4-362943/1992 or compounds (F-1) through (F-17) described on pages 18–19 in Japanese Patent O.P.I. Publication No. 6-83008/1994. Compounds (G-3), (G-5) or (G-6) is most preferable of compounds represented by Formula (G).

Compounds represented by Formula (G) are preferably used in combination with a nitrogen-containing heterocyclic compound. The nitrogen-containing heterocyclic compound includes 1,2,4-triazole or imidazole and further compounds (I-1) through (I-48) described on pages 4–7 in Japanese Patent O.P.I. Publication No. 4-359249/1992.

The content of the compound represented by Formula (G) in a stabilizer is preferably 0.05 to 20 g/liter, more preferably 0.1 to 15 g/liter, and still more preferably 0.5 to 10 g/liter.

The compounds represented by Formula (H-1) through (H-3) will be shown below.

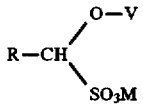

Formula (H-1)

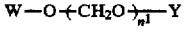

Formula (H-2)

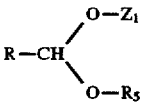

Formula (H-3)

In Formulas, R represents a hydrogen atom or an aliphatic hydrocarbon group; V represents a group capable of being released on hydrolysis; W and Y independently represent a hydrogen atom or a group capable of being released on hydrolysis; $n^1$ represents an integer of 1 to 10; $Z_1$ represents a hydrogen atom, an aliphatic hydrocarbon group, an aryl group or the other group capable of being released on hydrolysis; $R_5$ represents an aliphatic hydrocarbon group or an aryl group, provided that $Z_1$ may combine with $R_5$ to form a ring; and M represents a hydrogen atom, an ammonium group, an alkali metal atom or an organic ammonium group.

The aliphatic hydrocarbon group represented by R, $R_5$ or $Z_1$ represents an alkyl group (for example, an unsubstituted alkyl group such as methyl, ethyl or butyl or a substituted alkyl group such as carboxymethyl, methoxymethyl, methoxyethyl, hydroxyethyl or benzyl), an alkenyl group (for example, allyl or betenyl), an alkinyl group (for example, ethinyl) or a cyclic alkyl group (for example, cyclopentyl or cyclohexyl). The aryl group represented by $R_5$ or $Z_1$ may have a substituent. The substituent includes an alkyl group (for example, methyl, ethyl, methoxyethyl, benzyl, carboxymethyl or sulfopropyl), an aryl group (for example, phenyl, methoxyphenyl), a hydroxy group, an alkoxy group (for example, methoxy, ethoxy, methoxyethoxy), an aryloxy (for example, phenoxy, p-carboxyphenoxy), a carboxy group, a sulfo group, an alkoxycarbonyl group (for example, methoxycarbonyl, ethoxycarbonyl), an aryloxycarbonyl group (for example, phenoxycarbonyl), an amino group (for example, N,N-dimethylamino, N-ethylamino, N-phenylamino), an acylamido group (for example, acetoamide, benzamide), a carbamoyl group (for example, carbamoyl, N-methylcarbamoyl, N,N-tetramethylenecarbamoyl), a sulfonamido group (for example, methanesulfonamido, benzenesulfonamido), a sulfamoyl group (for example, ethyl sulfamoyl, N,N-diethylsulfamoyl), an alkylsulfonyl group (for example, methanesulfonyl, ethanesulfonyl), an arylsulfonyl group (for example, benzenesulfonyl, p-toluenesulfonyl) or an acyl group (for example, acetyl, benzoyl).

The group capable of being released on hydrolysis represented by V, W, Y or $Z_1$ is preferably an acyl group (for example, acetyl, benzoyl, trifluoroacetyl or monochloroacetyl) or a trialkylsilyl group (for example, trimethylsilyl). The ring in which $R_5$ and $Z_1$ may combine to form includes a 5-through 8-membered saturated ring or condensed ring, and may contain a hetero atom. The example thereof includes 1,2-dioxacyclopentane, m-dioxne, trioxane, tetraoxane and benzdioxolane.

The cation of M includes a hydrogen ion, an alkali metal ion (a lithium, sodium or potassium ion), an alkali earth metal ion (a magenesium or carcium ion), an ammonium ion, an organic ammonium ion (a triethylammonium ion, tripropylammonium ion tetramethylammonium ion) and a pyridinium ion.

The aliphatic hydrocarbon group represented by R preferably represents a lower alkyl group having one or two carbon atoms, and R more preferably represents a hydrogen atom.

The examples thereof will be shown below, but is not limited thereto.

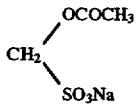

(H-1-1)

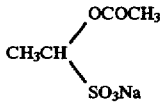

(H-1-2)

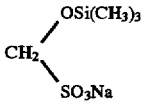

(H-1-3)

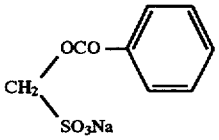

(H-1-4)

$CH_3COO(CH_2O)_3COCH_3$ (H-2-1)

$CH_3COO(CH_2O)_2COCH_3$ (H-2-2)

$CH_3COO(CH_2O)_4COCH_3$ (H-2-3)

$HO(CH_2O)_{10}H$ (H-2-4)

-continued
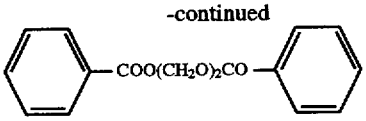
(H-2-5)
$(CH_3)_3SiO(CH_2O)_3Si(CH_3)$ (H-2-6)
$ClCH_2COO(CH_2O)_4COCH_2Cl$ (H-2-7)
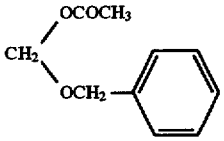
(H-3-1)
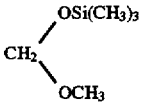
(H-3-1)
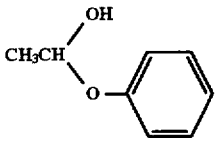
(H-3-3)
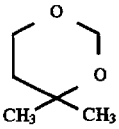
(H-3-4)
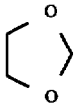
(H-3-5)
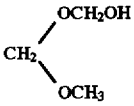
(H-3-6)
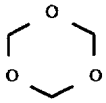
(H-3-7)
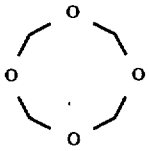
(H-3-8)
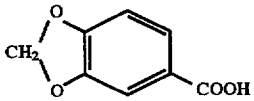
(H-3-9)
Of these (H-1-1), (H-1-2), (H-1-3), (H-2-4), (H-3-4), (H-3-6), and (H-3-7) are preferable. The content of the above compound in a stabilizer is preferably 0.01 to 20 g/liter, more preferably 0.03 to 15 g/liter, and still more preferably 0.05 to 10 g/liter.
The exemplified compounds of hexamethylenetetramines of the invention will be shown below.
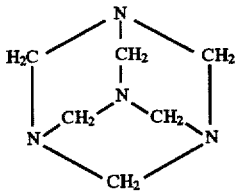
A-1
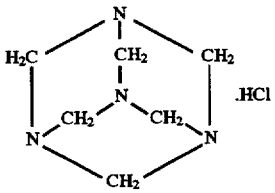
A-2
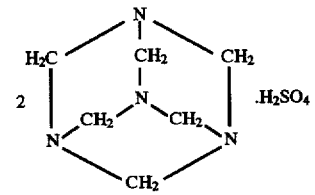
A-3
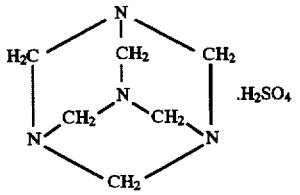
A-4
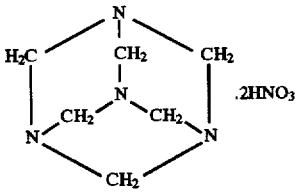
A-5
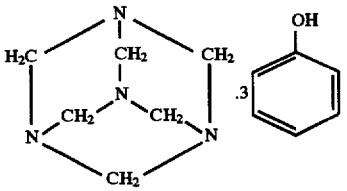
A-6
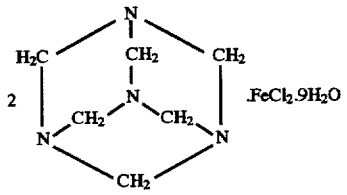
A-7
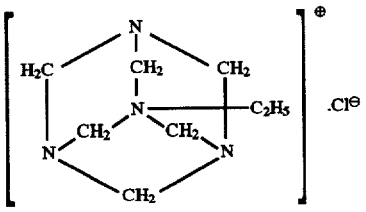
A-8

-continued
A-9
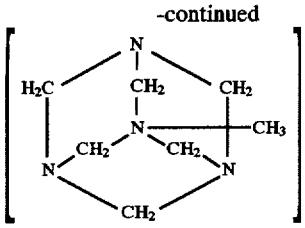
A-10
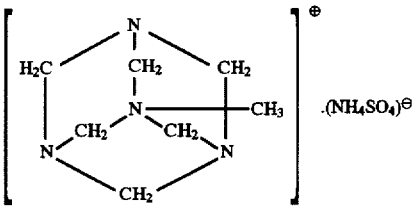
A-11
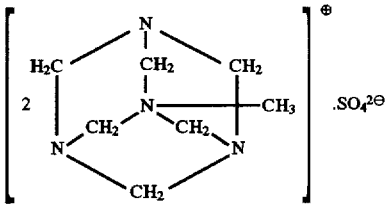
A-12
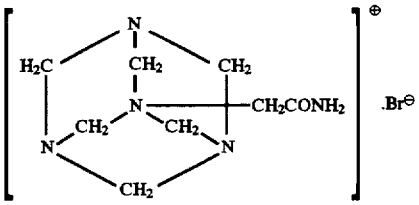
A-13
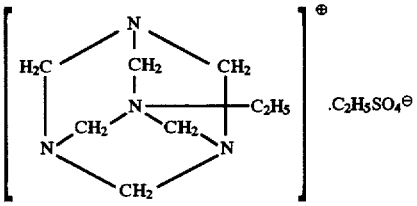
A-14
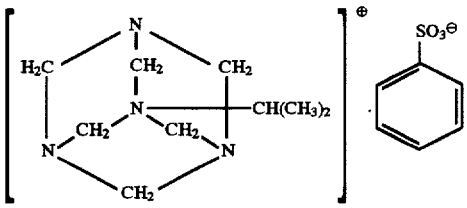
A-15
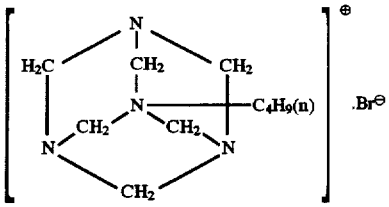
A-16
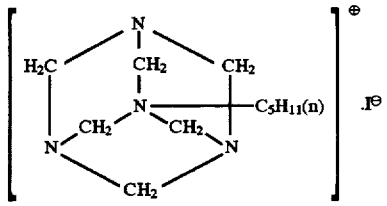
-continued
A-17
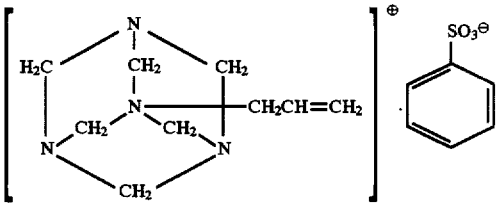
A-18
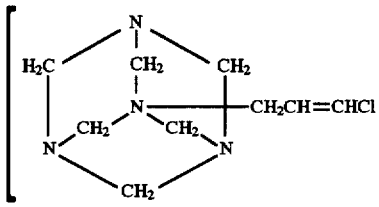
A-19
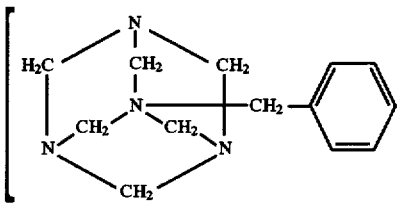
A-20
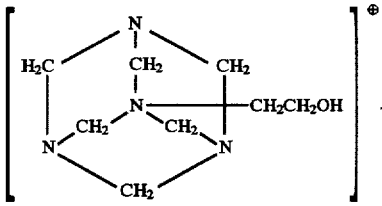
A-21
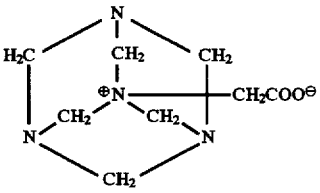
A-22
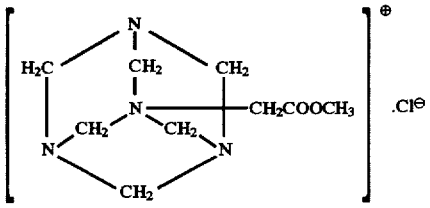
A-23
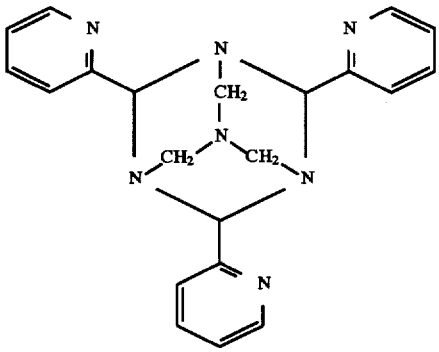

-continued

A-24

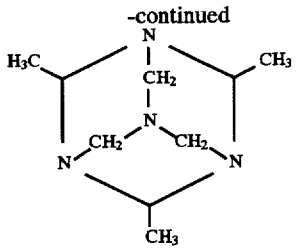

A-25

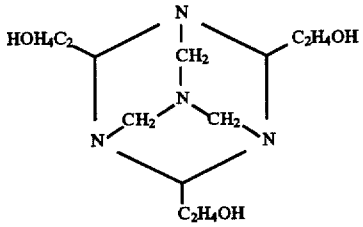

Of the above exemplified compounds, Compounds (A-1) through (A-7) are preferable, and Compound (A-1) is most preferable.

The content of the hexamethylenetetramine compound in a stabilizer is preferably 0.01 to 20 g/liter.

The content of compounds represented by Formulas (I), (G), (H-1) through (H-3) or a hexamethylenetetramine compound in the solid processing composition of the invention is 10 to 90% by weight and preferably 50 to 80% by weight. In the invention compounds represented by Formulas (I) are preferably used in view of the effects of the invention.

The saccharides in the invention refer to monosaccharides or polysaccharides in which monosaccharides bind through a glycosid bondage or decomposition compounds thereof.

Monosaccharides refer to as a polyhydroxy aldehyde, polyhydroxy ketone or their derivatives such as reduced derivatives, oxidized derivatives, deoxy derivatives, amino derivatives or thio derivatives. Most of them are represented by the general formula $C_nH_{2n}O_n$. The monosaccharides in the invention include derivatives derived from saccharide skeleton represented by the above formula. The preferable are sugar alcohols having a primary or secondary alcohol group to which an aldehyde or ketone group is reduced.

Polysaccharides include celluloses, starches or glycogens. The celluloses include derivatives such as cellulose ethers in which all or a part of hydroxy group are etherified, starches include maltose or dextrins that starches are hydrolyzed to various decomposition compounds. Celluloses may be in an alkali salt form in view of solubility. Among polysaccharides, celluloses or dextrins are preferably used, and dextrins are more preferably used.

Examples of monosaccharides in the invention will be shown below.

(Exemplified compounds)

B-(1) glycelaldehyde
B-(2) dihydroxyacetone (including a dimer)
B-(3) D-erythrulose
B-(4) L-erythrulose
B-(5) D-threose
B-(6) L-threose
B-(7) D-ribose
B-(8) L-ribose
B-(9) D-arabinose
B-(1) L-arabinose
B-(11) D-xylose
B-(12) L-xylose
B-(13) D-lixose
B-(14) L-lixose
B-(15) D-xylulose
B-(16) L-xylulose
B-(17) D-ribulose
B-(18) L-ribulose
B-(19) 2-deoxy-D-ribose
B-(20) D-allose
B-(21) L-allose
B-(22) D-altrose
B-(23) L-altrose
B-(24) D-glucose
B-(25) L-glucose
B-(26) D-mannose
B-(27) L-mannose
B-(28) D-gulose
B-(29) L-gulose
B-(30) D-idose
B-(31) L-idose
B-(32) D-galactose
B-(33) L-galactose
B-(34) D-talose
B-(35) L-talose
B-(36) D-quinobose
B-(37) digitalose
B-(38) Digitoxose
B-(39) Cymalose
B-(40) D-sorbose
B-(41) L-sorbose
B-(42) D-Tagatose
B-(43) D-fucose
B-(44) L-fucose
B-(45) 2-deoxy-D-glucose
B-(46) D-psicose
B-(47) D-fructose
B-(48) L-fructose
B-(49) D-rhamnose
B-(50) D-galactosamine
B-(51) L-galactosamine
B-(52) D-mannosamine
B-(53) D-glycero-D-galactoheptose
B-(54) D-glycero-D-mannoheptose
B-(55) D-glycero-L-mannoheptose
B-(56) D-glycero-D-guloheptose
B-(57) D-glycero-D-idoheptose
B-(58) D-glycero-L-glucoheptose
B-(59) D-glycero-L-taloheptose
B-(60) D-altroheptulose
B-(61) D-mannoheptulose
B-(62) D-altro-3-heptulose
B-(63) D-glucuronic acid
B-(64) L-glucuronic acid
B-(65) N-acetyl-D-glucosamine
B-(66) Glycerin
B-(67) D-threitol
B-(68) L-threitol
B-(69) Erithorit (produced by Mitsubishi Kasei Shokuhin Co. Ltd., Erythritol)
B-(70) D-arabitol
B-(71) L-arabitol
B-(72) adnite
B-(73) xylitol
B-(74) D-sorbitol
B-(75) L-sorbitol
B-(76) D-mannitol
B-(77) L-mannitol
B-(78) D-iditol
B-(79) L-iditol
B-(80) D-talitol B-(81) L-talitol
B-(82) dulcin
B-(83) allodulcitol Of these compounds, B-(66) through (83) are preferably used, and B-(69) and B-(74) through (83) are more preferably used.

Examples of polysaccharides and their decomposition compounds in the invention will be shown below.

C-(1) Maltose
C-(2) Cellobiose
C-(3) trehalose
C-(4) gentiobiose
C-(5) isomaltose
C-(6) lactose
C-(7) raffinose
C-(8) gentianose
C-(9) stachyose
C-(10) xylan
C-(11) araban
C-(12) Glycogen
C-(13) dextran
C-(14) inulin
C-(15) levan
C-(16) galactan
C-(17) agalose
C-(18) amylose
C-(19) sucrose
C-(20) agarobiose
C-(21) Methylcellulose
C-(22) Dimethylcellulose
C-(23) Trimethylcellulose
C-(24) Ethylcellulose
C-(25) Diethylcellulose
C-(26) Triethylcellulose
C-(27) Carboxymethylcellulose
C-(28) Carboxyethylcellulose
C-(29) Aminoethylcellulose
C-(30) Hydroxymethylcellulose
C-(31) Hydroxyethylcellulose
C-(32) Hydroxypropylcellulose
C-(33) Hydroxypropylmethylcellulose
C-(34) Hydroxypropylmethylcelluloseacetatesuccinate
C-(35) carboxymethylhydroxyethylcellulose
C-(36) α-dextrin
C-(37) β-dextrin
C-(38) γ-dextrin
C-(39) δ-dextrin
C-(40) ε-dextrin
C-(41) α-limit-dextrin
C-(42) β-limit-dextrin
C-(43) Phospherylase limit dextrim
C-(44) Soluble starch
C-(45) Thin-boling starch
C-(46) White dextrin
C-(47) Yellow dextrin
C-(48) British gumm
C-(49) α-cyclodextrin
C-(50) β-cyclodextrin
C-(51) γ-cyclodextrin
C-(52) Hydroxypropyl-α-cyclodextrin
C-(53) Hydroxypropyl-β-cyclodextrin
C-(54) Hydroxypropyl-γ-cyclodextrin
C-(55) Maltodextrin Of these compounds, C-(21) through (55) are preferably used, and compounds, C-(36) through (55) are more preferably used. The content of the saccharide in the solid processing composition of the invention for a silver halide photographic light-sensitive material is preferably 0.1 to 50 wt %, and more preferably 5 to 30 wt %. The weight average molecular weight of dextrins used in the invention may be any, but it is preferably 100 through 10000.

Saccharides exist widely in the nature, and are available on the market. The derivatives can be readily prepared by reduction, oxidation or dehydration reactions. The starch decomposition compounds available on the market include Pineflow, Pine-dex series, Food-rex, Max 100, Glistar P, MPD, H-PDX and Stuco-dex produced by Matstani Kagaku Co., Ltd. or Oil Q series produced by Nihon Yushi Co., Ltd.

Next, compounds represented by Formulas (K-I) through (K-IX) will be explained below.

In Formula (K-I), $A_1$ to $A_4$ may be the same with or the different from each other and represent each a hydrogen atom, a hydroxy group, —COOM', $—PO_3(M_1)_2$, $—CH_2COOM_2$, $—CH_2OH$ or a lower alkyl group which may have a substituent (for example, a methyl, ethyl, propyl or butyl group), provided that at least one of $A_1$ to $A_4$ represents —COOM', $—PO_3(M_1)_2$ or $—CH_2COOM_2$; and M', $M_1$ and $M_2$ represent each a hydrogen atom, an ammonium group, an alkali metal or an organic ammonium group.

In Formula (K-II), $A_{11}$ to $A_{14}$ may be the same with or the different from each other and represent each $—CH_2OH$, $—COOM^3$ or $—PO_3(M_4)_2$; $M^3$ and $M^4$ represent each a hydrogen atom, an ammonium group, an alkali metal or an organic ammonium group; and X represents an alkylene group having 2 to 6 carbon atoms (for example, an ethylene, propylene or butylene group) or $—(B_1O)_{n2}—B_2—$ in which $n^2$ is an integer of 1 to 8 and $B_1$ and $B_2$ may be the same with or the different from each other and represent each an alkylene group having 1 to 5 carbon atoms (for example, a methylene, ethylene, propylene or trimethylene group each of which may have a substituent such as a lower alkyl or hydroxy group).

In the foregoing Formula (K-III), $X_1$ represents a straight-chained or branched alkylene group having 2 to 6 carbon atoms (for example, a methylene, ethylene, propylene or isobutylene group), a saturated or unsaturated organic cyclic group (for example,

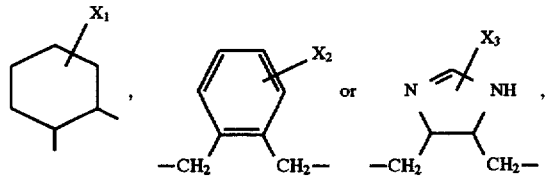

in which $X_1$, $X_2$ and $X_3$ represent each a hydrogen atom or of an alkyl group which may have a substituent the groups of ethylene, propylene or butylene) or $(B_{11}O)_{n7}—B_{12}$.

$B_{11}$ and $B_{12}$ may be the same as or different from each other and the alkylene group having 1 to 5 carbon atoms includes, for example, methylene, ethylene and trimethylene. These alkylene groups may also have a substituent including, for example, a lower alkyl group such as a methyl group, an ethyl group, or a hydroxy group. $A_{21}$ through $A_{24}$ may be the same with or the different from each other and represent each $—CH_2OH$, $—COOM_5$, $—N[(CH_2)_{n5}COOH][(CH_2)_{n6}COOH]$ or $—PO_3(M_6)_2$; $M_5$ and $M_6$ represent each a hydrogen atom, an ammonium group, an alkali metal atom or an organic ammonium group; $n_7$ represents an integer of 1 to 8; and $n_1$ through $n_6$ represents an integer of 1 to 4 and may be the same as or different from each other.

In Formula (K-IV), the represented by $R^1$ and $R^1$ represent each a hydrogen atom, an alkyl group which may have a substituent (for example, a straight-chained, branched or cyclic group having 1 to 10 carbon atoms, and preferably a methyl group or an ethyl group) or an aryl group which may have a substituent (preferably, a phenyl group). The substituents of $R^1$ and $R^1$ include, for example, an alkyl group, an aralkyl group, an alkenyl group, an alkinyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxy group, a phosphono group, an alkoxycarbonyl group, an aryloxycarbonyl group, an acyl group, an acyloxy group, a carbonamido group, a sulfonamido group and a nitro group. The preferable include those having the following formulas:

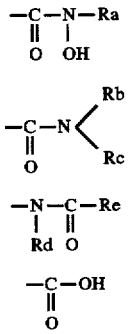

wherein Ra, Rb, Rc, Rd and Re represent each a hydrogen atom, an alkyl group or an aryl group.

In the above Formula (K-IV), $L_1$ represents $—Y_1(C{=}O)N(R_3)(OH)$, $—Y_2(C{=}X_2)N(R_4)(R^5)$ or $—Y_3—N(R_7)(C{=}X_3)N(R^6)$ in which $Y_1$ through $Y_3$ represent each an alkylene group (for example, a methylene group, an ethylene group or a propylene group) or an arylene group (for example, a phenylene group), $X_2$ and $X_3$ represent each an oxygen or sulfur atom, and $R^3$ through $R^7$ represent each a hydrogen atom, an alkyl group (for example, a methyl group, an ethyl group or a propyl group) or an aryl group (for example, a phenyl group). The arylene groups represented thereby include, for example, a phenylene group. Each of the alkylene groups and arylene groups represented by $Y_1$ through $Y_3$ may have a substituent. The substituent includes, for example, those given for the substituents of $R^1$ and $R^2$ and the following substituents are preferable.

—OH,

—COOH, $—CH_2COOM$, $—CH_2OH$, $—CONH_2$, $—CH_2CONH_2$ and $—CONHCH_3$ (in which M represents a hydrogen atom, an alkali metal or an ammonium group.)

Of compounds represented by Formula (K-IV) the preferable are those represented by the following Formula (B-I) and (B-II):

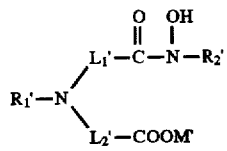

(B-I)

wherein $R_1'$ and $R_2'$ are the same as those denoted in above $R_1$ and $R_2$ and represent each a hydrogen atom, an alkyl group or an aryl group; $L_1'$ and $L_2'$ are the same as those denoted in above $Y_1$ through $Y_3$ and represent each an alkylene group or an arylene group; and $M_1'$ represents each a hydrogen atom, an alkali metal atom, an ammonium group or an organic ammonium group.

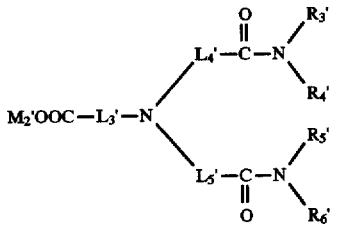

(B-II)

wherein $R_3'$ through $R_6'$ are the same as those denoted in $R_1'$ and $R_2'$ of Formula (B-1) and represent each a hydrogen atom, an alkyl group or an aryl group; $L_3'$ and $L_5'$ and $M_2'$ are the same as those denoted in $L_1'$ and $L_2'$ and $M_1'$ of Formula (B-1).

In the foregoing Formula (K-V), $R_{11}$ through $R_{13}$ and the substituent thereof are the same as those denoted in $R^1$ and $R^2$ in above Formula (K-IV). $L_2$ in the foregoing Formula (K-V) is the same as those denoted in $L_1$ in above Formula (K-IV).

In the foregoing Formula (K-V), the divalent linking groups represented by W include, preferably, an alkylene group having 2 to 8 carbon atoms (including a cyclohexylene group), an arylene group having 6 to 10 carbon atoms,

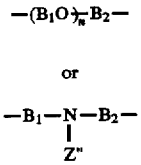

wherein $B_1$ and $B_2$ represent each an alkylene or arylene group and n is an integer of 1 to 3. Z" represents a hydrogen atom, an unsubstituted alkyl or aryl group, or an alkyl or aryl group substituted with —COOM, $—SO_3M$ or —OH in which M represents a hydrogen atom, an alkali metal or an ammonium group. These divalent linking groups may be combined with each other.

Among the compounds represented by Formula (K-V), the preferable ones include the compounds represented by the following Formula (B-III) or (B-IV).

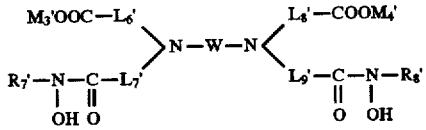

Formula (B-III)

wherein $R_7'$ and $R_8'$ are each synonymous with $R^1$ and $R^2$ of the foregoing Formula (K-IV); $L_6'$ through $L_9'$ are each synonymous with $Y^1$ through $Y^3$ of the foregoing Formula (K-IV); and $M_3'$ and $M_4'$ represent each a hydrogen atom, an alkali metal, an ammonium group or an organic ammonium group.

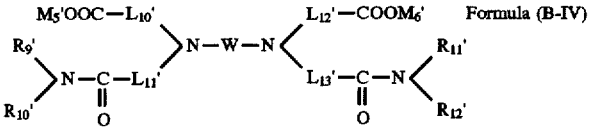

Formula (B-IV)

wherein $R_9'$ through $R_{12}'$ are each synonymous with $R_7'$ and $R_8'$ each denoted in Formula (B-III), and $L_{10}'$ through $L_{13}'$ and $M_5'$ and $M_6'$ are each synonymous with $L_6'$ through $L_9'$ and $M_3'$ and $M_4'$ denoted in Formula (B-III).

In Formula (K-VI), $R_{21}$ through $R_{23}$ and $R_{26}$ through $R_{29}$ represent each a hydrogen atom or a substituted or unsubstituted alkyl (for example, methyl, ethyl, propyl or butyl) or aryl (for example, phenyl) group; $R_{24}$ and $R_{25}$ represent each a hydrogen atom, a halogen atom (for example, chlorine, bromine or fluorine), a cyano group, a nitro group, an acyl group, a sulfamoyl group (for example, methylsulfamoyl), a carbamoyl group (for example, methylcarbamoyl or ethylcarbamoyl), an alkoxycarbonyl group (for example, methoxycarbonyl or ethoxycarbonyl), an aryloxycarbonyl group ( for example, phenoxycarbonyl), a sulfonyl group (for example, methylsulfonyl or ethylsulfonyl), a sulfinyl group (for example, methylsulfinyl or ethylsulfinyl), provided that $R_{24}$ and $R_{25}$ may combine to form a 5-membered or 6-membered ring. The 5-membered or 6-membered ring includes a benzene, pyrazine, benzopyrazine, 2H-pyrazine or pyrimidine ring; A represents a carboxy group, a phosphono group, a sulfo group, a hydroxy group or an alkyl metal salt or ammonium salt thereof; $Y_4$ represents an alkylene group (for example, methylene or ethylene) or an arylene group (for example, phenylene) which may have a substituent (the substituent includes those denoted in $R_3$ and $R_4$ of Formula (G)); and t and u are each an integer of 0 or 1.

In the foregoing Formula (K-VII), n' is an integer of 1 to 3; $A_{31}$ through $A_{34}$ and $B_{31}$ through $B_{35}$ represent each —H, —OH, $—C_{n''}H_{2n''+1}$, or $—(CH_2)_{m_1}X_5$ in which n" and $m_1$ are an integer of 1 to 3 and 0 to 3, respectively; and $X_5$ represents $—COOM_3$ (in which $M_3$ represents a hydrogen atom, an ammonium group or an alkali metal atom), $—NH_2$ or —OH, provided that $B_{31}$ through $B_{35}$ are not simultaneously hydrogen atoms.

In the foregoing Formula (K-VIII), $A_{41}$ to $A_{44}$ may be the same with or the different from each other and represent each $—COOM_{21}$, —OH, $—PO_3(M_{21})(M_{22})$ or $—CONH_2$; $M_{21}$ and $M_{22}$ represent each a hydrogen atom, an alkali metal atom or an ammonium group; $n_{11}$ through $n_{14}$ represents 0, 1 or 2; $R_{31}$ through $R_{34}$ represent each a hydrogen atom, a lower alkyl group (for example, a methyl, ethyl or propyl group) or a hydroxy group, provided that when $n_{11}+n_{12}=1$ and $n_{13}+n_{14}=1$, $R_{31}$ through $R_{34}$ are not simultaneously hydrogen atoms.

$X_4$ represents a substituted or unsubstituted alkylene group having 2 to 6 carbon atoms (for example, an ethylene, propylene or butylene group) or $—(B_{21}O)_{m11}—B_{22}—$ in which $m_{11}$ is an integer of 1 to 4 and $B_{21}$ and $B_{22}$ may be the same with or the different from each other and represent each a substituted or unsubstituted alkylene group having 1 to 5 carbon atoms (for example, a methylene, ethylene or trimethylene group each of which may have a substituent such as a lower alkyl or hydroxy group).

In the foregoing Formula (K-IX), $R_{40}$ through $R_{42}$ represent each a hydrogen atom, —OH, a substituted or unsubstituted lower alkyl group (for example, a methyl, ethyl or propyl group), in which the substituent includes, for example, —OH, $—COOM_7$ or $—PO_3(M_8)_2$; $B_{41}$ through $B_{43}$ represent each a hydrogen atom, —OH, $—COOM_7$, $—PO_3(M_8)_2$ or $—N(R')_2$ in which R' represents each a hydrogen atom, an alkyl group having 1 to 5 carbon atoms such as a methyl group, an ethyl group or a propyl group, or $—PO_3(M_8)_2$; $M_4$, $M_7$, and $M_8$ represent each a hydrogen atom or an alkali metal atom; and $n^{10}$ and m represent each an integer of 0 or 1.

The typical examples of the invention represented by Formulas (K-I) through (K-IX) will be shown below, but the invention is not limited thereto.

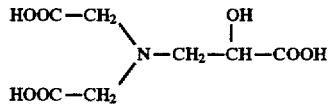

K-I-1

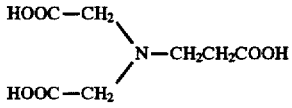

K-I-2

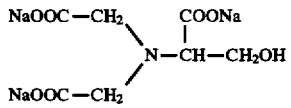

K-I-3

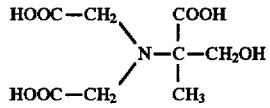

K-I-4

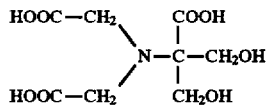

K-I-5

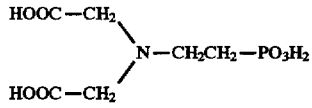

K-I-6

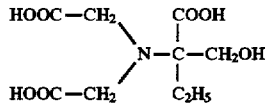

K-I-7

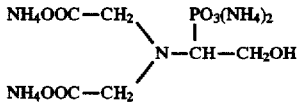

K-I-8

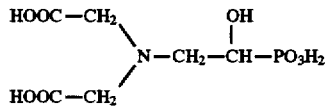

K-I-9

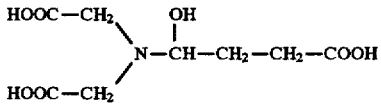

K-I-10

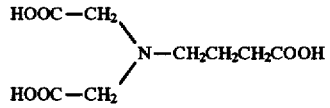

K-I-11

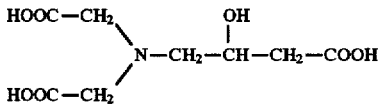

K-I-12

-continued
K-I-13
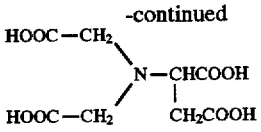
K-I-14
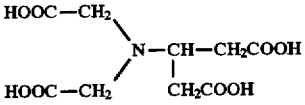
K-I-15
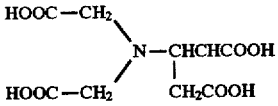
K-II-1
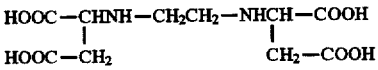
K-II-2
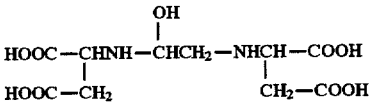
K-II-3
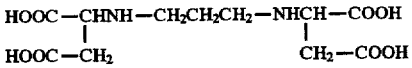
K-II-4
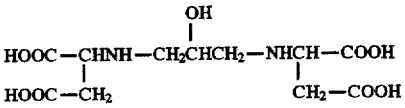
K-II-5
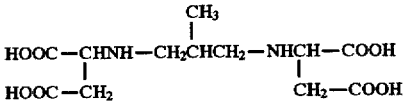
K-II-6
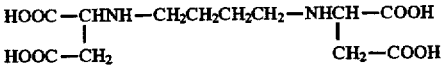
K-II-7
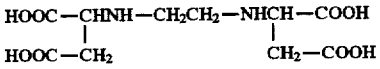
K-II-8
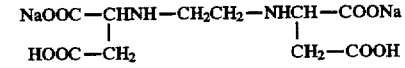
K-II-9
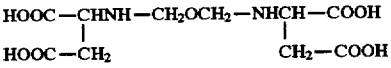
K-II-10
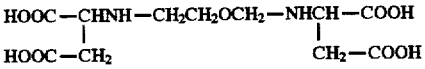
K-II-11
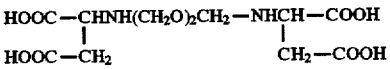
K-II-12
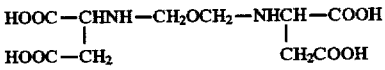
K-II-13
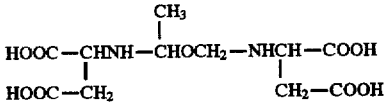
K-II-14
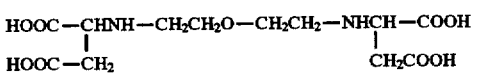
K-II-15
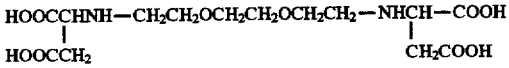
-continued
K-II-16
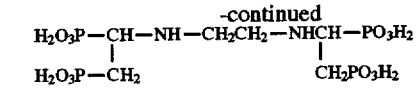
K-II-17
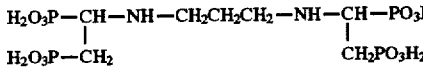
K-III-1
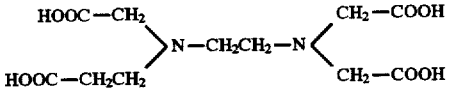
K-III-2
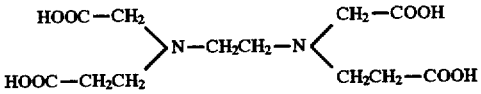
K-III-3
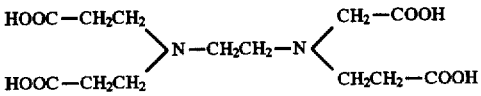
K-III-4
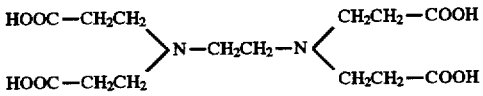
K-III-5
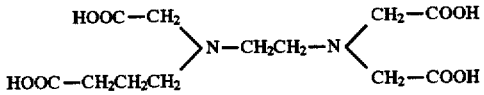
K-III-6
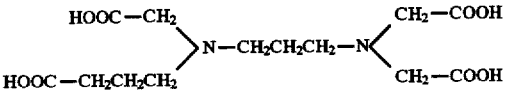
K-III-7
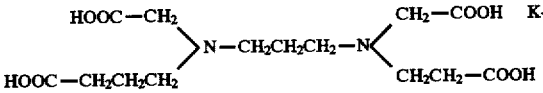
K-III-8
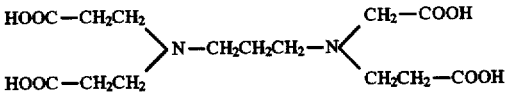
K-III-9
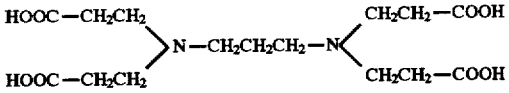
K-III-10
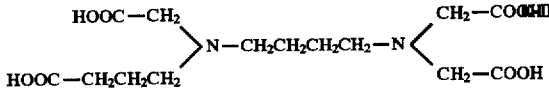
K-III-11
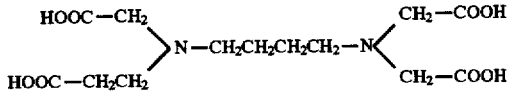
K-III-12
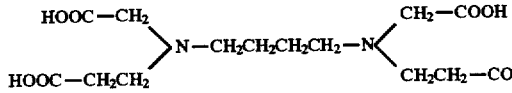
K-III-13
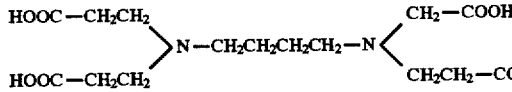
K-III-14
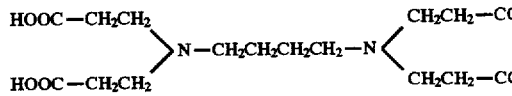
K-III-15
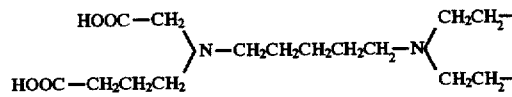

-continued
K-III-16
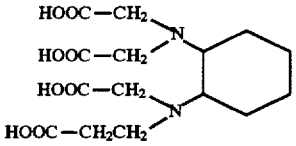
K-III-17
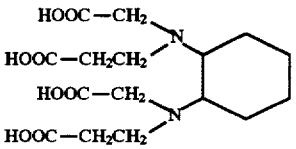
K-III-18
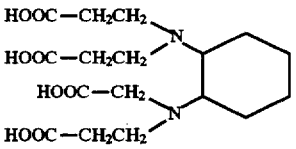
K-III-19
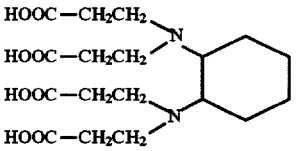
K-III-20
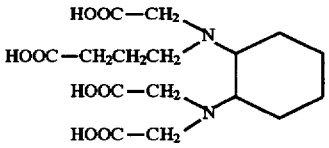
K-III-21
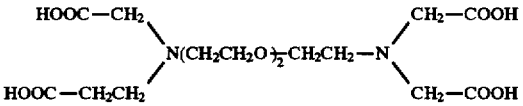
K-III-22
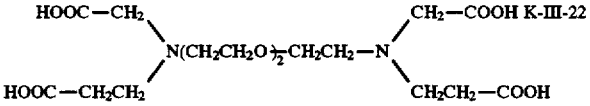
K-III-23
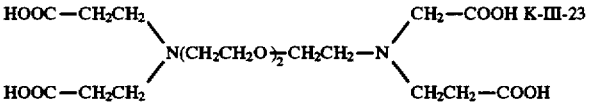
K-III-24
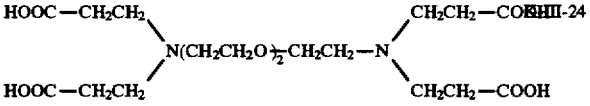
K-III-25
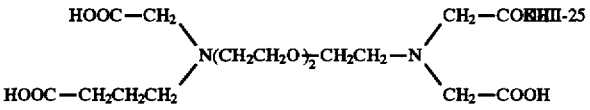
K-III-26
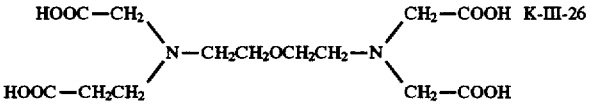
K-III-27
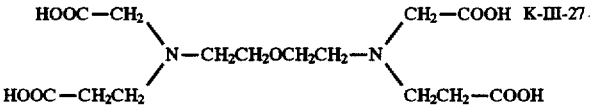
-continued
K-III-28
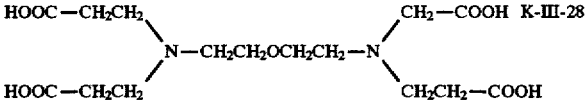
K-III-29
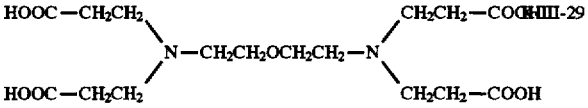
K-III-30
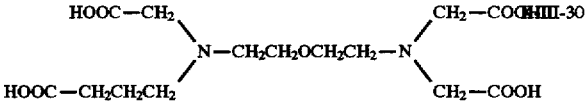
K-III-31
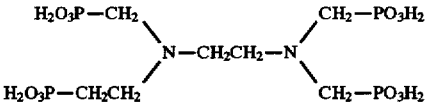
K-III-32
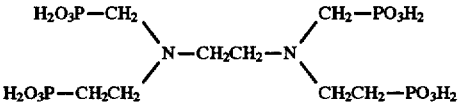
K-III-33
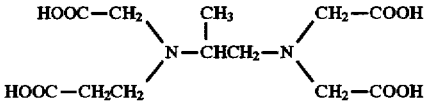
K-III-34
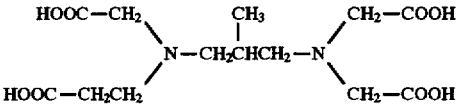
K-III-35
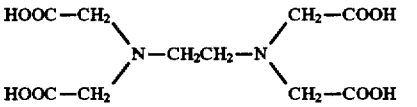
K-III-36
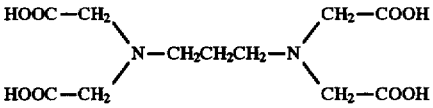
K-III-37
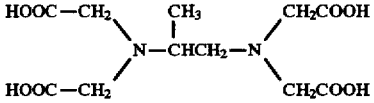
K-III-38
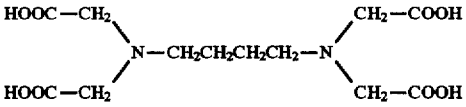
K-III-39
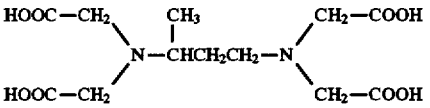
K-III-40
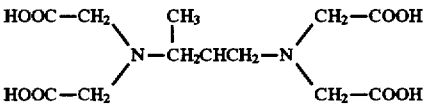
K-III-41
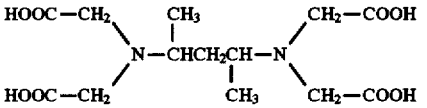

-continued
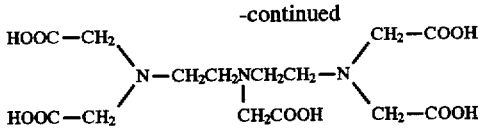
K-III-42
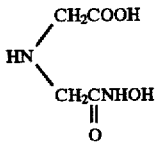
K-IV-1
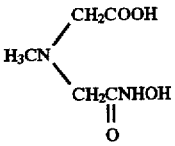
K-IV-2
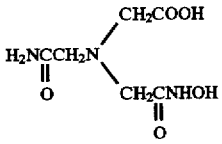
K-IV-3
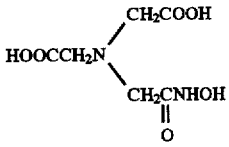
K-IV-4
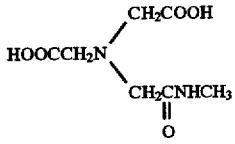
K-IV-5
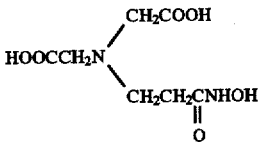
K-IV-6
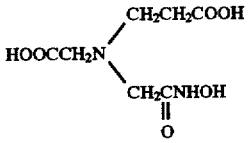
K-IV-7
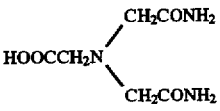
K-IV-8
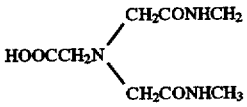
K-IV-9
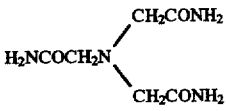
K-IV-10
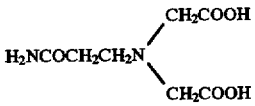
K-IV-11
-continued
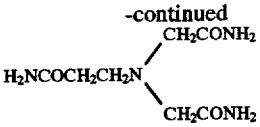
K-IV-12
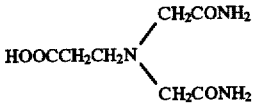
K-IV-13
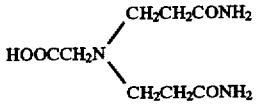
K-IV-14
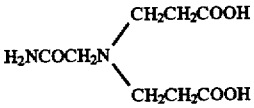
K-IV-15
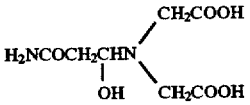
K-IV-16
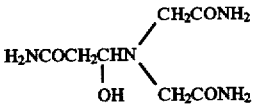
K-IV-17
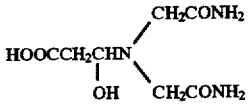
K-IV-18
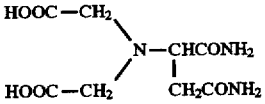
K-IV-19
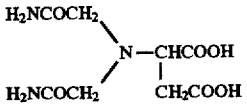
K-IV-20
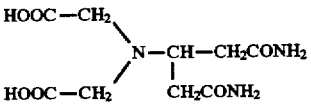
K-IV-21
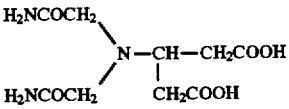
K-IV-22
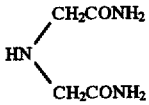
K-IV-23
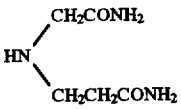
K-IV-24
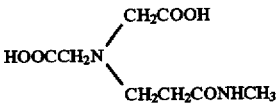
K-IV-25

-continued
K-IV-26
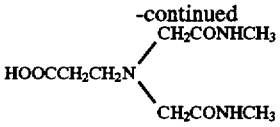
K-IV-27
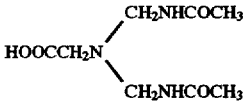
K-IV-28
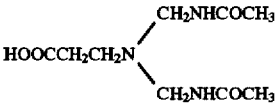
K-IV-29
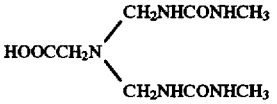
K-IV-30
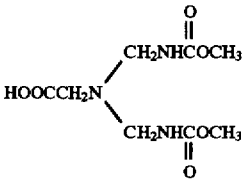
K-V-1
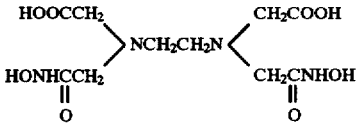
K-V-2
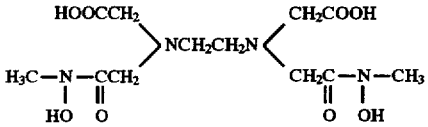
K-V-3
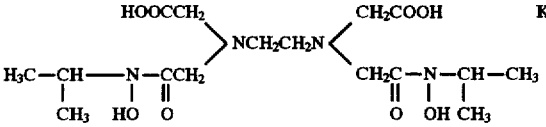
K-V-4
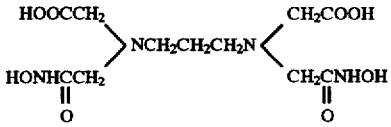
K-V-5
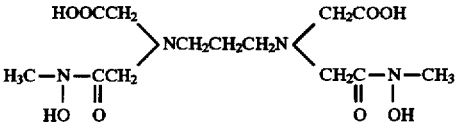
K-V-6
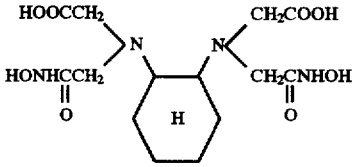
K-V-7
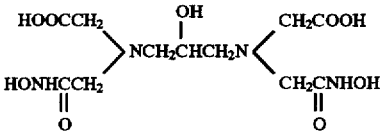
-continued
K-V-8
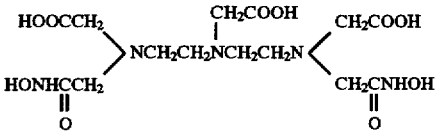
K-V-9
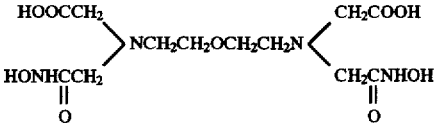
K-V-10
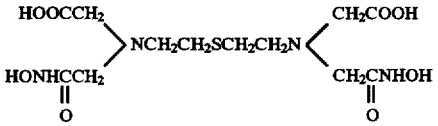
K-V-11
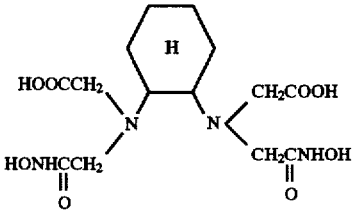
K-V-12
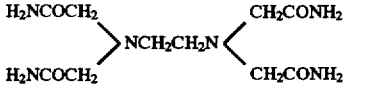
K-V-13
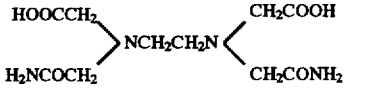
K-V-14
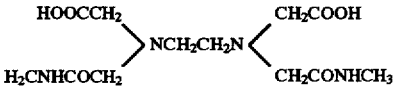
K-V-15
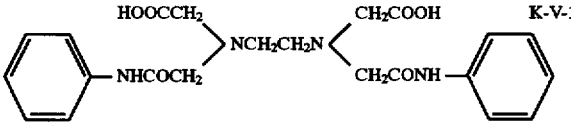
K-V-16
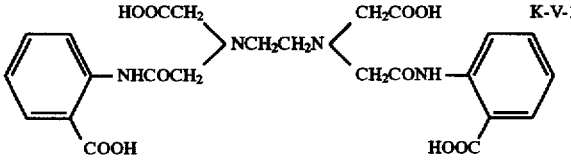
K-V-17
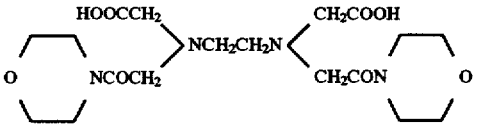
K-V-18
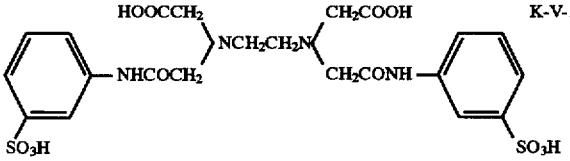
K-V-19
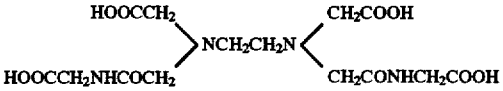

-continued
K-V-20
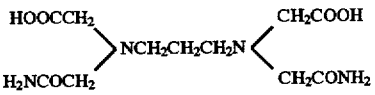
K-V-21
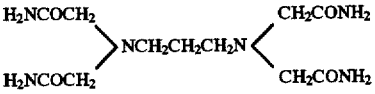
K-V-22
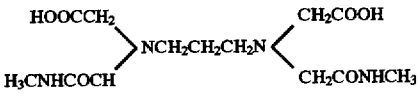
K-V-23
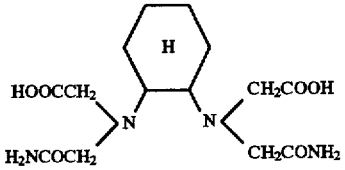
K-V-24
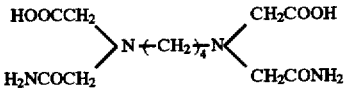
K-V-25
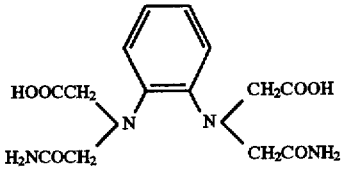
K-V-26
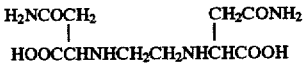
K-V-27
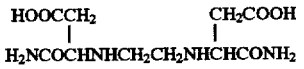
K-V-28
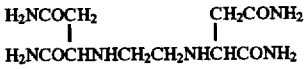
K-V-29
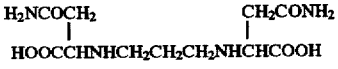
K-V-30
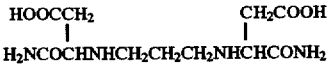
K-V-31
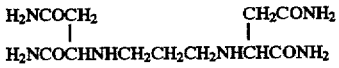
K-V-32
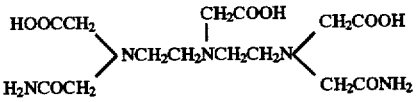
K-V-33
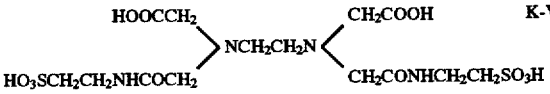
K-V-34
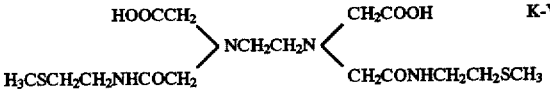
K-V-35
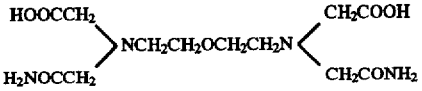
-continued
K-VI-1
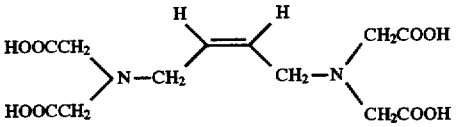
A-VI-2
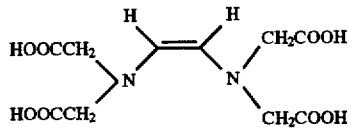
A-VI-3
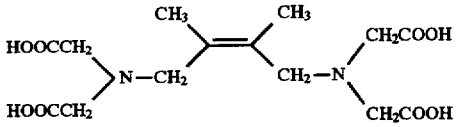
A-VI-4
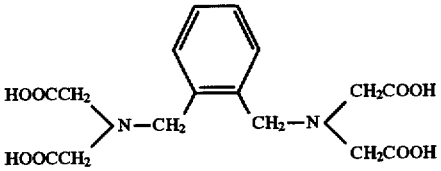
A-VI-5
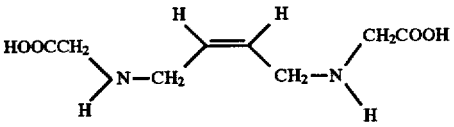
A-VI-6
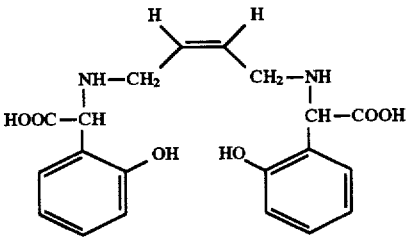
A-VI-7
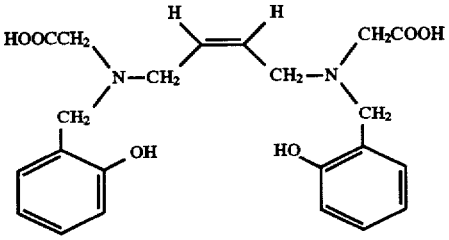
A-IV-8
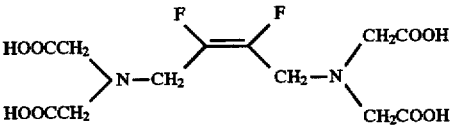
A-IV-9
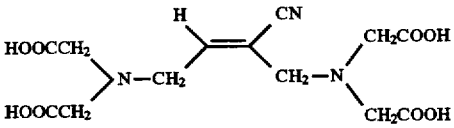
A-IV-10
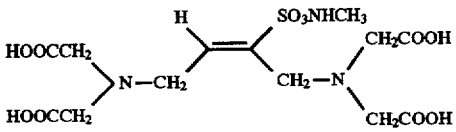

-continued
A-IV-11
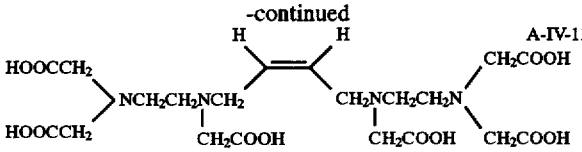
A-IV-12
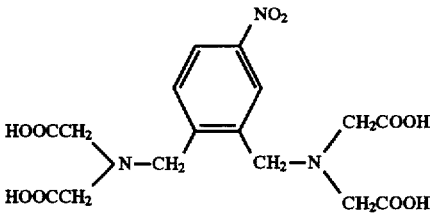
A-VI-13
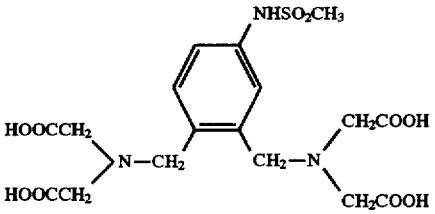
A-IV-14
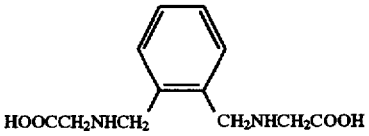
A-IV-15
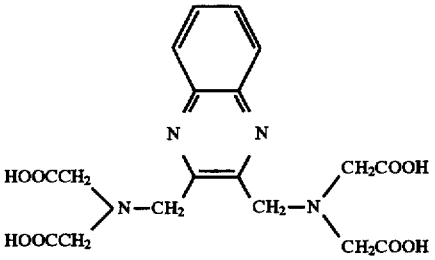
K-VI-16
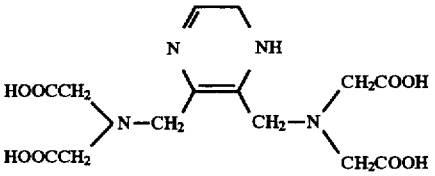
K-VIII-1
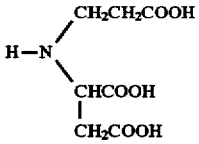
K-VII-2
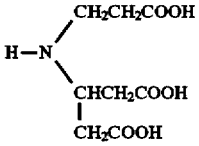
K-VII-3
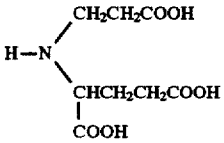
-continued
K-VII-4
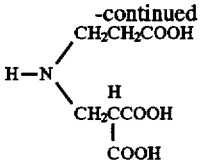
K-VII-5
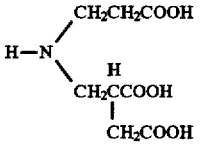
K-VII-6
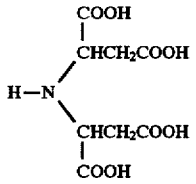
K-VII-7
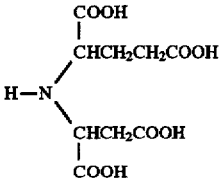
K-VII-8
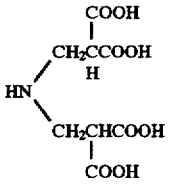
K-VII-9
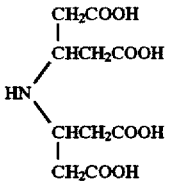
K-VII-10
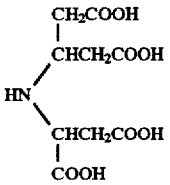
K-VII-11
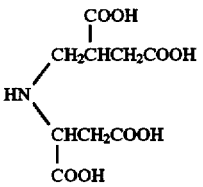
K-VII-12
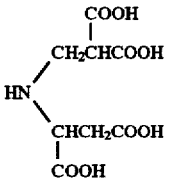

-continued
K-VII-13
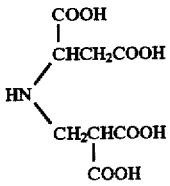
K-VII-14
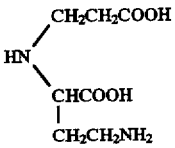
K-VII-15
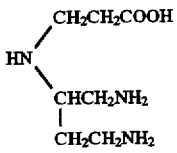
K-VII-16
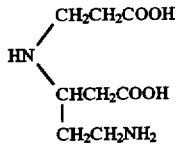
K-VII-17
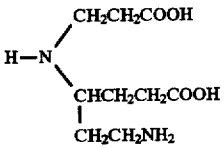
K-VII-18
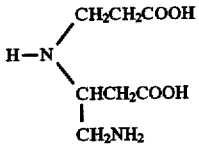
K-VII-19
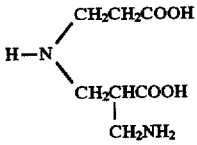
K-VII-20
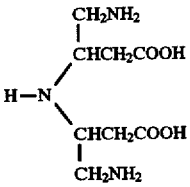
K-VII-21
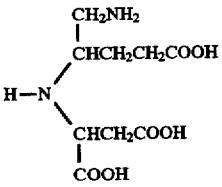
-continued
K-VII-22
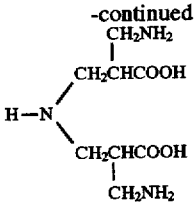
K-VII-23
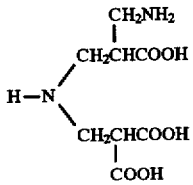
K-VII-24
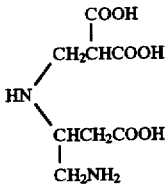
K-VII-25
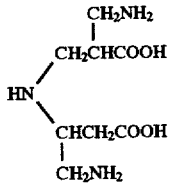
K-VII-26
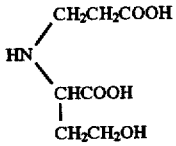
K-VII-27
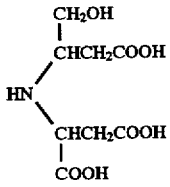
K-VII-28
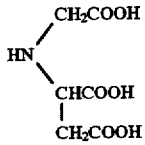
K-VII-29
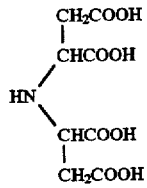
K-VIII-1
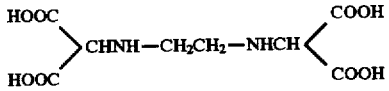
K-VIII-2
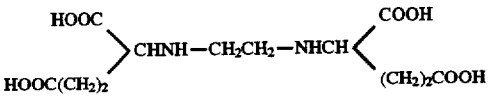

-continued

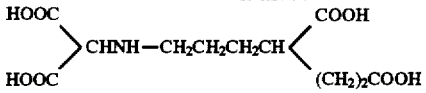
K-VIII-3

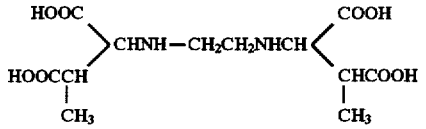
K-VIII-4

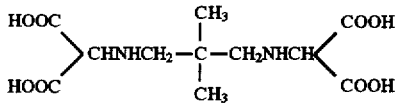
K-VIII-5

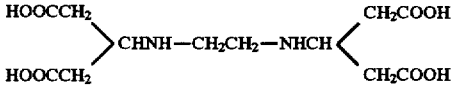
K-VIII-6

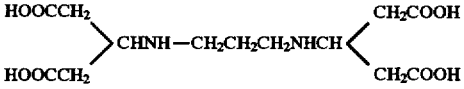
K-VIII-7

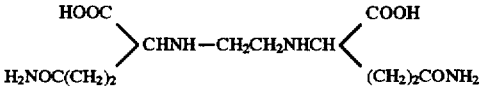
K-VIII-8

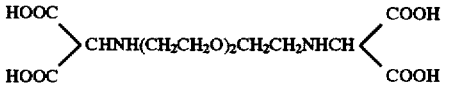
K-VIII-9

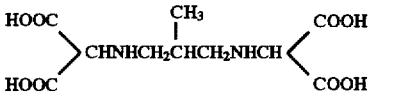
K-VIII-10

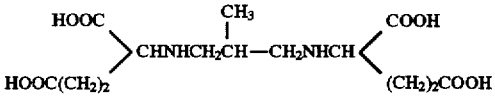
K-VIII-11

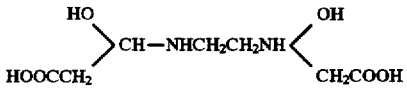
K-VIII-12

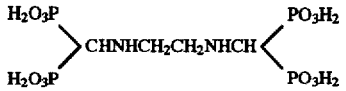
K-VIII-13

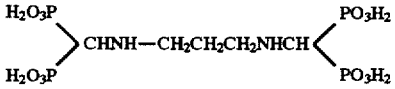
K-VIII-14

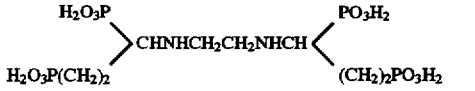
K-VIII-15

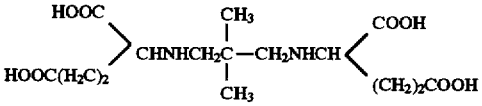
K-VIII-16

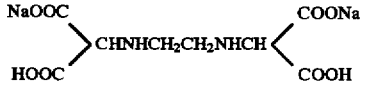
K-VIII-17

-continued

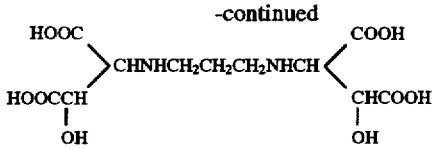
K-VIII-18

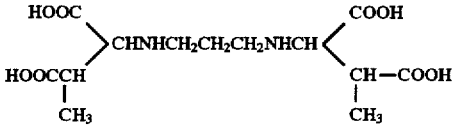
K-VIII-19

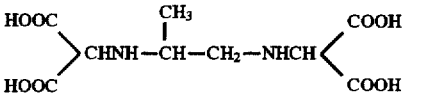
K-VIII-20

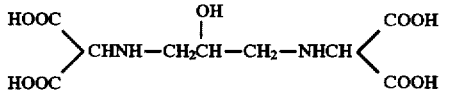
K-VIII-21

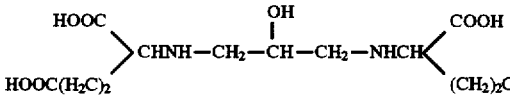
K-VIII-22

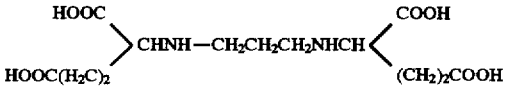
K-VIII-23

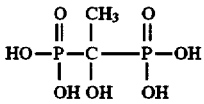
K-IX-1

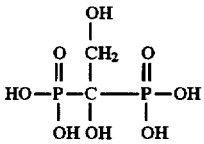
K-IX-2

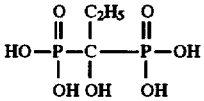
K-IX-3

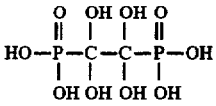
K-IX-4

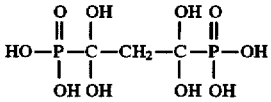
K-IX-5

The above compounds may be a salt with Na, K, $NH_4$ or Li, in view of adjusting pH, and may have a crystal water. Of the above exemplified compounds Compounds (K-I-2), (K-II-7), (K-III-35), (K-III-36), (K-III-42), (K-V-13), (K-VI-4), (K-VIII-28), (K-VIII-29), and (K-IX-3) are preferable, and (K-III-35), (K-III-36), (K-III-42) and (K-IX-3) are more preferable.

The content of compounds represented by Formulas (K-I) through (K-IX) in the solid processing composition for a silver halide color photographic light-sensitive material of the invention is 0.1 to 50% by weight and preferably 5 to 30% by weight. In the invention compounds represented by Formulas (I) are preferably used in view of the effects of the invention.

The total content of saccharides and compounds represented by Formulas (K-I) through (K-IX) in the solid processing composition for a silver halide color photographic light-sensitive material of the invention is 0.1 to 50% by weight and preferably 5 to 30% by weight. (Total weight of saccharides and compounds represented by Formulas (K-I) through (K-IX)/ Total weight of the solid processing composition×100)

The compounds represented by Formulas (I), (G) and (H-1) through (H-3) and a tetramethylene compound may be contained in the solid processing composition of the invention with the saccharides and/or compounds represented by Formulas (K-I) through (K-IX). The alkali agent may be added to adjust pH of the solid processing agent. The example thereof include potassium hydroxide, lithium hydroxide, a carbonate, a bicarbonate, a phosphate and a borate.

The solid processing composition of the invention may contain an anionic surfactant to improve wettability of a color negative film. The anionic surfactant is preferably a fluorine-containing anionic surfactant. The fluorine-containing anionic surfactant is represented by the following Formula (D):

$$Rf-(X)_{m_{21}}-(Y)_{n_{21}}-A \qquad \text{Formula (D)}$$

wherein Rf represents a saturated or unsaturated aliphatic group containing at least one fluorine atom, which preferably has 4 to 12 carbon atoms, and more preferably has 6 to 9 carbon atoms; X represents a sulfonamide group,

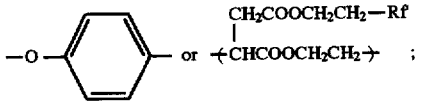

in which Rf' represents a saturated or unsaturated hydrocarbon group containing at least one fluorine atom; Y represents alkyleneoxy or alkylene; A represents $-SO_3M''$, $-OSO_3M''$, $-COOM''$, $-OPO_3(M_1')(M_2'')$ or $-PO_3(M_1'')(M_2'')$, and preferably $-SO_3M''$, in which M", $M_1''$ and $M_2''$ independently represent H, Li, K, Na or $NH_4$, preferably Li, K, Na, and more preferably Li; $m_{21}$ represents 0 or 1; and $n_{21}$ represents an integer of 0 to 10. $m_{21}$ and $n_{21}$ preferably are simultaneously 0.

The exemplified compounds thereof will be shown below, but is not limited thereto.

$C_8F_{17}SO_3K$ D-1

$C_8F_{17}SO_3Li$ D-2

$C_8F_{17}COONH_4$ D-3

$C_8F_{17}COOK$ D-4

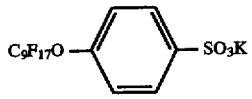

D-5

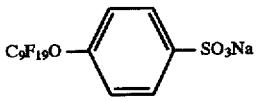

D-6

-continued

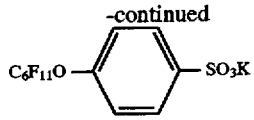

D-7

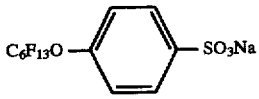

D-8

$C_7F_{15}COONH_4$ D-9

$$\begin{array}{l} CH_2COOCH_2CH_2C_8F_{17} \\ | \\ NaO_3S-CHCOOCH_2CH_2C_8F_{17} \end{array}$$ D-10

$$\begin{array}{l} C_3H_7 \\ | \\ C_8F_{17}SO_2NCH_2COOK \end{array}$$ D-11

$$\begin{array}{l} C_3H_7 \\ | \\ C_8F_{17}SO_2N-CH_2CH_2OPO_3Na_2 \end{array}$$ D-12

$$\begin{array}{l} C_{12}H_{25} \\ | \\ C_8F_{17}SO_2N(C_2H_4O)_7C_4H_8SO_3Na \end{array}$$ D-13

Of the above exemplified compounds represented by Formula (D), Compounds (D-1), (D-2) and (D-4) are preferable.

The content of compounds of Formula (D) is 0.001 to 1 g, preferably 0.01 to 0.5 g per liter of a stabilizing solution.

The solid processing composition of the invention may contain an anti-funji agent in such an amount that the effects of the invention are not inhibited.

EXAMPLES

The invention will be detailed in the following Examples, but is not limited thereto.

Example 1

The solid stabilizing composition was prepared according to the following Procedures.

| Solid processing composition for stabilizer | |
|---|---|
| Compound represented by Formula (I) | Shown in Table 1 |
| Additives | Shown in Table 1 |

Procedure (1)

In a granulating mixer were granulated 1500 g of the compound represented by Formula (I) and 200 g of additives, which are shown in Table 1, while gradually adding 34 ml of water. Thereafter, the resulting granules were dried in a drier at 60° C. for 4 hours to have a moisture content of not more than 0.5 weight % and then, dressed using a dresser available on the market equipped with a 1.5 mm mesh screen. Thus, a granule sample was obtained.

Procedure (2)

The above obtained granule sample was tableted at a pressure of 1400 kg/cm$^2$ in a loading amount of 9.0 g/tablet using a Tough Press Collect 1527HU produced by Kikusui Seisakusho Co., Ltd., which was modified, to obtain a Φ30, 10 mm tablet.

Regarding the above obtained granule and tablet samples the following experiments were carried out.

(Experiments)

Regarding the above obtained granule (shown as K in Table 1) and tablet (shown as J in Table 1) samples, 500 g of the granules and 50 tablets (about 450 g) were individually tightly sealed in an aluminium package inside which a polyethylene film is laminated, and stored for two weeks in an apparatus in which the temperature varied from −10° to 50° C. per day.

The resulting samples were evaluated as follows:

(1) Reduction of compounds represented by Formula (1) (Granules and Tablets)

After the storage, 45 g of the granules and 5 tablets (about 45 g) were individually dissolved in 1 liter of water and absorbance of 254 nm of the solution was measured by means of a spectrophotometer (UA-160A produced by Shimazu Seisakusho Co., Ltd.). The absorbance was compared with that of the sample before the storage. Thus, the reduction rate after the storage was calculated.

(2) Coloration (Granules and Tablets)

The samples after the storage were checked visually.

(3) Occurrence of needle crystals (Granules and Tablets)

The samples after the storage were checked visually.

(4) Expansion rate (Tablets)

After the storage, the diameter of 10 tablets was measured with vernier calipers available on the market and their average value was compared with that of the samples before the storage.

(5) Hardness (Tablets)

After the storage, 10 tablets were measured with a hardness meter available on the market such as TS50N produced by Okada Seiko Co., Ltd. and their average value was calculated.

(6) Blocking (Granules)

After the storage, 50 g of the granules were sieved with a sieve of about 2 mm mesh, and blocking (aggregation) of the granules plus the sieve were checked visually.

(7) Odor

After the storage, odor of the samples was checked.

(8) Image stability after storage

The photographic films, later specified, were running processed using Konica Color Processor KP-50J and Konica Ecotab Cartridge Color Negative Initial Kit, and the maximum magenta density ($DM_1$) of a final film of the processed films was measured. The maximum magenta density ($DM_2$) of the final film after storage at 65° C. and 50% RH for 2 weeks was measured. The density reduction rate of the maximum magenta density was calculated by the following equation:

$$\Delta D(\%)=(DM_1-DM_2)\times 100/DM_1$$

The running conditions were as follows:

As a starter solution, Konica Ecotab Cartridge Color Negative Initial Kit (produced by Konica Corporation) was used, and as a replenisher, Konica Ecotab Cartridge Color Negative Replenisher, N-1 (developer replenisher), N-2 (bleach replenisher) and N-3 (fixer replenisher) (each produced by Konica Corporation) were used. As a stabilizer replenisher, the granules or tablets as shown in Tables 1, 2 and 3 were used and replenished at a rate of 33 ml/24 EX. through the filter tank of Konica Color Processor KP-50J to maintain a concentration of a formaldehyde alternative of 1.5 g per liter. "24EX." refers to as a photographic film used herein which is Konica Color Super DD100 with 24 exposures (produced by Konica Corporation). Konica Color Super DD100 with 24 exposures was imagewise exposed and running processed at a rate of 50 rolls per day until the stabilizer replenisher in an amount 3 times the content of the stabilizer tank was replenished.

The evaluation criteria of (2), (3), (6) and (7) above were as follows:

(Evaluation Criteria)

(2) Coloration

◎: No change before and after the storage

○: Partly brownish, but no problem in commercial value

Δ: Entirely brownish and partly black stains

×: Entirely blackened and of no commercial value (3) Occurrence of needle crystals (Granules and Tablets)

◎: No needle crystal observed

○: Needle crystals observed slightly on the surface of the package, but none observed on the surface of the samples and no problem in commercial value Δ: Needle crystals observed slightly on the surface of the samples ×: Many needle crystals were observed on the surface of both package and samples, resulting in a product of no commercial value.

(6) Blocking

◎: All granules passed through the screen.

○: One to two % of the granules remained on the screen but all granules passed through the screen after forcing them with fingers.

Δ: Two to ten % of the granules remained on the screen but all granules passed through the screen after forcing them with fingers.

×: Not less than ten % of the granules remained on the screen but 5% of the granules were still not broken after forcing them with fingers.

(7) Odor

◎: No odor detected

○: Scarcely any odor detected but slight odor detected after sniffing the samples at close range Δ: Odor detected upon opening the package ×: Irritating odor occurred, resulting in sneezing The results are shown in Tables 1 through 3.

TABLE 1

| Experiment No. | Compound represented by Formula (I) | Additive | Form of Solid Processing Composition | Reduction Rate of Compound represented by Formula (I) (%) | Evaluation after Storage: Coloration | Occurrence of Needle Crystals | Expansion of Diameter (%) | Hardness of Tablets (kg) | Blocking | Odor | Reduction Rate of Magenta Density (%) | Remarks |
|---|---|---|---|---|---|---|---|---|---|---|---|---|
| 1-1 | I-3 | None | K | 29.1 | XX | X | — | — | X | X | 20.1 | Comp. |
| 1-2 | I-3 | None | J | 24.6 | X | Δ | 6.7 | 19.6 | — | X | 17.6 | Comp. |
| 1-3 | I-2 | B-76 | K | 4.9 | ○ | ○ | — | — | ○ | ○ | 4.2 | Inv. |
| 1-4 | I-2 | B-76 | J | 4.7 | ◎ | ○ | 0.7 | 65.4 | — | ○ | 4.0 | Inv. |
| 1-5 | I-3 | B-76 | K | 2.1 | ◎ | ◎ | — | — | ◎ | ◎ | 2.0 | Inv. |
| 1-6 | I-3 | B-76 | J | 1.8 | ◎ | ◎ | 0.4 | 67.8 | — | ◎ | 1.1 | Inv. |
| 1-7 | I-4 | B-76 | K | 4.3 | ○ | ○ | — | — | ○ | ○ | 3.8 | Inv. |
| 1-8 | I-4 | B-76 | J | 3.8 | ◎ | ◎ | 0.9 | 66.3 | — | ◎ | 3.2 | Inv. |
| 1-9 | I-6 | B-76 | K | 4.6 | ○ | ○ | — | — | ○ | ○ | 4.2 | Inv. |
| 1-10 | I-6 | B-76 | J | 3.5 | ◎ | ◎ | 0.6 | 62.4 | — | ◎ | 4.0 | Inv. |
| 1-11 | I-23 | B-76 | K | 4.8 | ○ | ○ | — | — | ○ | ○ | 4.0 | Inv. |
| 1-12 | I-23 | B-76 | J | 4.5 | ◎ | ◎ | 0.7 | 64.5 | — | ◎ | 3.6 | Inv. |
| 1-13 | I-24 | B-76 | K | 4.8 | ○ | ○ | — | — | ○ | ○ | 3.1 | Inv. |
| 1-14 | I-24 | B-76 | J | 4.5 | ◎ | ◎ | 0.6 | 64.4 | — | ◎ | 2.8 | Inv. |
| 1-15 | I-52 | B-76 | K | 4.9 | ○ | ○ | — | — | ○ | ○ | 2.0 | Inv. |
| 1-16 | I-52 | B-76 | J | 4.8 | ◎ | ○ | 0.7 | 62.5 | — | ◎ | 1.9 | Inv. |
| 1-17 | I-55 | B-76 | K | 4.6 | ○ | ○ | — | — | ○ | ○ | 4.0 | Inv. |
| 1-18 | I-55 | B-76 | J | 4.3 | ○ | ○ | 1.3 | 58.1 | — | ◎ | 3.8 | Inv. |
| 1-19 | I-62 | B-76 | K | 4.9 | ○ | ○ | — | — | ○ | ○ | 3.8 | Inv. |
| 1-20 | I-62 | B-76 | J | 4.7 | ○ | ○ | 1.2 | 57.6 | — | ◎ | 3.6 | Inv. |
| 1-21 | I-72 | B-76 | K | 4.7 | ○ | ○ | — | — | ○ | ○ | 3.7 | Inv. |
| 1-22 | I-72 | B-76 | J | 4.5 | ○ | ○ | 1.0 | 59.9 | — | ◎ | 3.5 | Inv. |

Comp.: Comparative, Inv.: Invention

TABLE 2

| Experiment No. | Compound represented by Formula (I) | Additive | Form of Solid Processing Composition | Reduction Rate of Compound represented by Formula (I) (%) | Evaluation after Storage: Coloration | Occurrence of Needle Crystals | Expansion of Diameter (%) | Hardness of Tablets (kg) | Blocking | Odor | Reduction Rate of Magenta Density (%) | Remarks |
|---|---|---|---|---|---|---|---|---|---|---|---|---|
| 1-23 | I-3 | *1 PEG6000 | K | 26.7 | XX | Δ | — | — | X | X | 22.6 | Comp. |
| 1-24 | I-3 | *1 PEG6000 | J | 22.3 | X | Δ | 8.9 | 10.6 | — | X | 19.8 | Comp. |
| 1-25 | I-3 | B-69 | K | 3.9 | ○ | ○ | — | — | ○ | ○ | 4.1 | Inv. |
| 1-26 | I-3 | B-69 | J | 3.1 | ◎ | ◎ | 0.7 | 60.6 | — | ○ | 4.0 | Inv. |
| 1-27 | I-3 | B-74 | K | 2.1 | ◎ | ○ | — | — | ◎ | ○ | 3.8 | Inv. |
| 1-28 | I-3 | B-74 | J | 1.8 | ◎ | ◎ | 0.4 | 67.8 | — | ○ | 3.7 | Inv. |
| 1-29 | I-3 | C-6 | K | 4.0 | ○ | ○ | — | — | ○ | ○ | 4.1 | Inv. |
| 1-30 | I-3 | C-6 | J | 3.6 | ○ | ○ | 0.9 | 60.2 | — | ○ | 4.0 | Inv. |
| 1-31 | I-3 | C-33 | K | 5.6 | ○ | ○ | — | — | ○ | ○ | 3.6 | Inv. |
| 1-32 | I-3 | C-33 | J | 4.8 | ○ | ○ | 1.1 | 58.6 | — | ○ | 3.4 | Inv. |
| 1-33 | I-3 | C-36 | K | 4.7 | ○ | ○ | — | — | ○ | ○ | 3.8 | Inv. |
| 1-34 | I-3 | C-36 | J | 4.2 | ○ | ○ | 1.2 | 57.7 | — | ○ | 3.5 | Inv. |
| 1-35 | I-3 | C-49 | K | 2.0 | ◎ | ◎ | — | ◎ | ◎ | 2.0 | Inv. | |
| 1-36 | I-3 | C-49 | J | 1.2 | ◎ | ◎ | 0.4 | 66.6 | — | ◎ | 1.7 | Inv. |
| 1-37 | I-3 | C-50 | K | 1.8 | ◎ | ◎ | — | — | ◎ | ◎ | 1.5 | Inv. |
| 1-38 | I-3 | C-50 | J | 1.1 | ◎ | ◎ | 0.4 | 67.2 | — | ◎ | 0.9 | Inv. |
| 1-39 | I-3 | C-51 | K | 1.9 | ◎ | ◎ | — | — | ◎ | ◎ | 2.0 | Inv. |
| 1-40 | I-3 | C-51 | J | 1.3 | ◎ | ◎ | 0.7 | 64.4 | — | ◎ | 1.7 | Inv. |
| 1-41 | I-3 | C-53 | K | 2.0 | ◎ | ◎ | — | — | ○ | ○ | 3.7 | Inv. |
| 1-42 | I-3 | C-53 | J | 1.3 | ◎ | ◎ | 0.6 | 63.3 | — | ○ | 3.0 | Inv. |
| 1-43 | I-3 | C-55 | K | 3.7 | ○ | ◎ | — | — | ○ | ○ | 3.5 | Inv. |
| 1-44 | I-3 | C-55 | J | 3.2 | ○ | ○ | 1.0 | 59.9 | — | ○ | 3.2 | Inv. |
| 1-45 | I-3 | *2 Pineflow | K | 4.0 | ◎ | ◎ | — | — | ○ | ○ | 2.9 | Inv. |
| 1-46 | J-3 | *2 Pineflow | J | 3.3 | ○ | ○ | 1.2 | 60.0 | — | ○ | 2.8 | Inv. |
| 1-47 | I-3 | *3 Pinedex #3 | K | 3.8 | ○ | ○ | — | — | ○ | ○ | 3.0 | Inv. |
| 1-48 | I-3 | *3 Pinedex #3 | J | 3.3 | ○ | ○ | 1.3 | 55.7 | — | ○ | 2.7 | Inv. |

TABLE 2-continued

| Experiment No. | Compound represented by Formula (I) | Additive | Form of Solid Processing Composition | Evaluation after Storage: Reduction Rate of Compound represented by Formula (I) (%) | Coloration | Occurrence of Needle Crystals | Expansion of Diameter (%) | Hardness of Tablets (kg) | Blocking | Odor | Reduction Rate of Magenta Density (%) | Remarks |
|---|---|---|---|---|---|---|---|---|---|---|---|---|
| 1-49 | I-3 | *4 Oil Q | K | 4.7 | ○ | ○ | — | — | ○ | ○ | 4.4 | Inv. |
| 1-50 | I-3 | *4 Oil Q | J | 3.9 | ○ | ○ | 1.5 | 57.7 | — | ○ | 4.1 | Inv. |

Comp.: Comparative, Inv.: Invention
*1: polyethyleneglycol having a weight average molecular weight of 6000
*2, *3: maltodextrin produced by Matsutani kagaku Co., Ltd.
*4: maltodextrin produced by Nihon Yushi Co., Ltd.

TABLE 3

| Experiment No. | Compound represented by Formula (I) | Additive | Form of Solid Processing Composition | Evaluation after Storage: Reduction Rate of Compound represented by Formula (I) (%) | Coloration | Occurrence of Needle Crystals | Expansion of Diameter (%) | Hardness of Tablets (kg) | Blocking | Odor | Reduction Rate of Magenta Density (%) | Remarks |
|---|---|---|---|---|---|---|---|---|---|---|---|---|
| 1-51 | I-3 | K-I-2 | K | 4.7 | ○ | Δ | — | — | ○ | ○ | 3.5 | Inv. |
| 1-52 | I-3 | K-I-2 | J | 3.2 | ○ | ○ | 0.7 | 68.9 | — | ○ | 3.4 | Inv. |
| 1-53 | I-3 | K-I-7 | K | 4.5 | ○ | ○ | — | — | ○ | ○ | 3.5 | Inv. |
| 1-54 | I-3 | K-I-7 | J | 3.6 | ○ | ○ | 0.6 | 70.7 | — | ○ | 3.4 | Inv. |
| 1-55 | I-3 | K-III-35 | K | 2.0 | ◎ | ○ | — | — | ○ | ◎ | 2.0 | Inv. |
| 1-56 | I-3 | K-III-35 | J | 1.8 | ◎ | ◎ | 0.4 | 78.8 | — | ◎ | 1.3 | Inv. |
| 1-57 | I-3 | K-III-36 | K | 2.1 | ◎ | ○ | — | — | ○ | ◎ | 1.9 | Inv. |
| 1-58 | I-3 | K-III-36 | J | 1.7 | ◎ | ◎ | 0.4 | 76.5 | — | ◎ | 1.5 | Inv. |
| 1-59 | I-3 | K-v-13 | K | 4.2 | ○ | ○ | — | — | ○ | ○ | 3.6 | Inv. |
| 1-60 | I-3 | K-v-13 | J | 3.5 | ○ | ○ | 0.8 | 71.4 | — | ○ | 3.4 | Inv. |
| 1-61 | I-3 | K-VI-4 | K | 4.6 | ○ | ○ | — | — | ○ | ○ | 3.5 | Inv. |
| 1-62 | I-3 | K-VI-4 | J | 3.2 | ○ | ○ | 0.9 | 69.2 | — | ○ | 3.3 | Inv. |
| 1-63 | I-3 | K-VIII-28 | K | 4.1 | ○ | ○ | — | — | ○ | ○ | 4.4 | Inv. |
| 1-64 | I-3 | K-VIII-28 | J | 3.6 | ○ | ○ | 0.9 | 70.1 | — | ○ | 4.0 | Inv. |
| 1-65 | I-3 | K-VIII-29 | K | 3.9 | ○ | ○ | — | — | ○ | ○ | 4.0 | Inv. |
| 1-66 | I-3 | K-VIII-29 | J | 3.0 | ○ | ○ | 0.9 | 75.4 | — | ○ | 3.8 | Inv. |
| 1-67 | I-3 | K-VIII-3 | K | 2.3 | ◎ | ○ | — | — | ○ | ◎ | 2.0 | Inv. |
| 1-68 | I-3 | K-VIII-3 | J | 1.7 | ◎ | ◎ | 0.5 | 72.7 | — | ◎ | 1.5 | Inv. |
| 1-69 | I-3 | a* | K | 1.8 | ◎ | ○ | — | — | ○ | ◎ | 1.8 | Inv. |
| 1-70 | I-3 | a* | J | 1.3 | ◎ | ◎ | 0.4 | 82.2 | — | ◎ | 1.3 | Inv. |
| 1-71 | I-3 | b** | K | 2.2 | ◎ | ○ | — | — | ○ | ◎ | 1.2 | Inv. |
| 1-72 | I-3 | b** | J | 1.2 | ◎ | ◎ | 0.4 | 79.9 | — | ◎ | 0.9 | Inv. |
| 1-73 | I-3 | c*** | K | 2.0 | ◎ | ○ | — | — | ○ | ◎ | 1.1 | Inv. |
| 1-74 | I-3 | c*** | J | 1.5 | ◎ | ◎ | 0.5 | 81.1 | — | ◎ | 0.9 | Inv. |

Comp.: Comparative, Inv.: Invention
a*: Disodium salt of K-III-35
b**: Dipotassium salt of K-III-36
c***: Pentasodium salt of K-III-42

As is apparent from the above, the solid processing composition of the invention is excellent in view of storage stability and odor. The solid processing composition of the invention, which contains compounds represented by Formulas (K-I) through (K-IX), is excellent in view of storage stability and improved in tablet hardness by 5 to 15 kg. Further, Reduction rate of magenta density is excellent in the photographic films processed with the solid processing composition of the invention.

Example 2

The solid stabilizing composition was prepared according to the following Procedures.

Procedure (3)

Tablet samples were prepared in the same manner as in Procedures (1) and (2) of Example 1, except that exemplified compounds (I-3) and (C-50), a disodium salt of exemplified compound (K-III-35) and anhydrous sodium carbonate were used in an amount shown in Table 4.

The above obtained samples were individually tightly sealed in an aluminium package inside which a polyethylene film is laminated, and stored for 3 weeks in an apparatus in which the temperature varied from −20° to 60° C. per day.

The resulting samples were evaluated in the same manner as in Example 1.

The results are shown in Tables 4.

TABLE 4

| Experiment No. | Content of Compound (I-3) (wt %) | Content of anhydrous sodium carbonate (wt %) | Content of Compound (C-50) (wt %) | Content of a disodium salt of Compound (K-III-35) (wt %) | Form of Solid Processing Composition | Evaluation after Storage: Reduction Rate of Compound represented by Formula (I) (%) | Coloration | Occurrence of Needle Crystals | Expansion of Diameter (%) | Hardness of Tablets (kg) | Odor | Reduction Rate of Magenta Reduction (%) | Remarks |
|---|---|---|---|---|---|---|---|---|---|---|---|---|---|
| 2-1 | 100.0 | 0 | 0 | 0 | J | 35.4 | X | X | 10.6 | 14.7 | X | 26.1 | Comp. |
| 2-2 | 99.99 | 0 | 0.01 | 0 | J | 8.9 | ○ | ○ | 2.1 | 52.0 | ○ | 1.8 | Inv. |
| 2-3 | 99.9 | 0 | 0.1 | 0 | J | 6.2 | ○ | ○ | 1.4 | 56.3 | ○ | 1.8 | Inv. |
| 2-4 | 99.0 | 0 | 1.0 | 0 | J | 4.7 | ○ | ○ | 1.3 | 59.6 | ○ | 1.7 | Inv. |
| 2-5 | 95.0 | 0 | 5.0 | 0 | J | 2.8 | ◎ | ◎ | 0.9 | 62.3 | ◎ | 0.9 | Inv. |
| 2-6 | 90.0 | 0 | 10.0 | 0 | J | 2.0 | ◎ | ◎ | 0.9 | 65.6 | ◎ | 0.7 | Inv. |
| 2-7 | 70.0 | 0 | 30.0 | 0 | J | 1.7 | ◎ | ◎ | 0.8 | 67.1 | ◎ | 0.7 | Inv. |
| 2-8 | 50.0 | 0 | 50.0 | 0 | J | 1.9 | ○ | ○ | 1.5 | 58.1 | ○ | 2.6 | Inv. |
| 2-9 | 40.0 | 0 | 60.0 | D | J | 4.5 | ○ | ○ | 2.2 | 53.0 | ○ | 2.5 | Inv. |
| 2-10 | 99.99 | 0 | 0 | 0.01 | j | 8.9 | ○ | ○ | 2.1 | 60.3 | ○ | 2.6 | Inv. |
| 2-11 | 99.9 | 0 | 0 | 0.1 | j | 5.9 | ○ | ○ | 1.5 | 70.1 | ○ | 2.2 | Inv. |
| 2-12 | 99.0 | 0 | 0 | 1.0 | J | 4.8 | ○ | ○ | 1.3 | 72.6 | ○ | 1.6 | Inv. |
| 2-13 | 95.0 | 0 | 0 | 5.0 | J | 2.9 | ◎ | ◎ | 0.9 | 75.7 | ◎ | 0.9 | Inv. |
| 2-14 | 90.0 | 0 | 0 | 10.0 | J | 2.2 | ◎ | ◎ | 0.8 | 77.4 | ◎ | 0.8 | Inv. |
| 2-15 | 70.0 | 0 | 0 | 30.0 | J | 1.9 | ◎ | ◎ | 0.7 | 80.3 | ◎ | 0.8 | Inv. |
| 2-16 | 50.0 | 0 | 0 | 50.0 | J | 2.1 | ○ | ○ | 1.2 | 76.4 | ○ | 1.7 | Inv. |
| 2-17 | 40.0 | 0 | 0 | 60.0 | J | 4.0 | ○ | ○ | 2.2 | 62.4 | ○ | 2.0 | Inv. |
| 2-18 | 99.98 | 0 | 0.01 | 0.01 | J | 8.5 | ○ | ○ | 2.0 | 65.5 | ○ | 1.9 | Inv. |
| 2-19 | 99.9 | 0 | 0.05 | 0.05 | J | 6.7 | ◎ | ◎ | 0.6 | 80.7 | ◎ | 0.7 | Inv. |
| 2-20 | 90.0 | 0 | 2.5 | 2.5 | J | 1.4 | ◎ | ◎ | 0.5 | 95.6 | ◎ | 0.8 | Inv. |
| 2-21 | 70.0 | 0 | 15.0 | 15.0 | J | 1.1 | ◎ | ◎ | 0.4 | 100.1 | ◎ | 0.7 | Inv. |
| 2-22 | 50.0 | 0 | 25.0 | 25.0 | J | 1.8 | ◎ | ◎ | 0.3 | 113.2 | ◎ | 0.6 | Inv. |
| 2-23 | 40.0 | 0 | 30.0 | 30.0 | J | 4.1 | ○ | ○ | 2.3 | 90.0 | ○ | 1.8 | Inv. |
| 2-24 | 70.0 | 30 | 0 | 0 | J | 27.5 | XX | X | 8.7 | 12.6 | X | 21.1 | Comp. |
| 2-25 | 70.0 | 20 | 10.0 | 0 | J | 2.3 | ○ | ○ | 1.5 | 59.2 | ○ | 2.3 | Inv. |
| 2-26 | 70.0 | 20 | 0 | 10.0 | J | 2.6 | ○ | ○ | 1.4 | 71.6 | ○ | 2.0 | Inv. |
| 2-27 | 70.0 | 10 | 10.0 | 10.0 | J | 1.5 | ◎ | ◎ | 0.4 | 97.6 | ◎ | 0.7 | Inv. |

Comp.: Comparative, Inv.: Invention

As is apparent from the above, the solid processing composition of the invention is excellent in view of storage stability and odor in more severe conditions. The solid processing composition of the invention, which contains a saccharide or compounds represented by Formulas (K-I) through (K-IX) in an amount of 5 to 30 wt %, gives more improved results. The combination use of exemplified compound (I-3), a compound represented by Formula (I) and compounds represented by Formulas (K-I) through (K-IX) gives greatly improved hardness and storage stability. Further, magenta density is excellent in the photographic films processed with the solid processing composition of the invention as compared with comparative samples.

Example 3

Granule sample and tablet sample were prepared in the same manner as in Experiment Nos. 1–37 and 1–38 of Example 1, except that 130 g of lithium hydroxide and 130 g of exemplified compound (D-2) were further added. The above obtained samples were evaluated in the same manner as in Example 1. The results are substantially the same as Example 1.

Example 4

Granule sample and tablet sample were prepared in the same manner as in Experiment Nos. 1–37 and 1–38 of Example 1, except that compounds as shown in Table 5 were used as a compound represented by Formula (I). The above obtained samples were evaluated in the same manner as in Example 1. The results are shown in Table 5.

TABLE 5

| Experiment No. | Exemplified Compound | Additive | Form of Solid Processing Composition | Evaluation after Storage: Reduction Rate of Exemplified Compound (%) | Coloration | Expansion of Diameter (%) | Hardness of Tablets (kg) | Blocking | Reduction Rate of Magenta (%) | Odor | Remarks |
|---|---|---|---|---|---|---|---|---|---|---|---|
| 3-1 | I-3 | None | K | 29.1 | XX | — | — | X | 20.1 | X | Comp. |
| 3-2 | I-3 | None | J | 24.6 | X | 6.7 | 19.6 | — | 17.6 | X | Comp. |
| 3-3 | I-3 | C-50 | K | 1.8 | ◎ | — | — | ◎ | 1.5 | ◎ | Inv. |
| 3-4 | I-3 | C-50 | J | 1.1 | ◎ | 0.4 | 67.2 | — | 0.9 | ◎ | Inv. |

TABLE 5-continued

| Experiment No. | Exemplified Compound | Additive | Form of Solid Processing Composition | Evaluation after Storage: Reduction Rate of Exemplified Compound (%) | Coloration | Expansion of Diameter (%) | Hardness of Tablets (kg) | Blocking | Reduction Rate of Magenta (%) | Odor | Remarks |
|---|---|---|---|---|---|---|---|---|---|---|---|
| 3-5 | G-3 | C-50 | K | 5.6 | ○ | — | — | ○ | 4.5 | ○ | Inv. |
| 3-6 | G-3 | C-50 | J | 5.1 | ○ | 1.5 | 58.6 | — | 4.0 | ○ | Inv. |
| 3-7 | G-5 | C-50 | K | 5.5 | ○ | — | — | ○ | 4.7 | ○ | Inv. |
| 3-8 | G-5 | C-50 | J | 5.o | ○ | 1.7 | 57.2 | — | 4.2 | ○ | Inv. |
| 3-9 | G-6 | C-50 | K | 5.2 | ○ | — | — | ○ | 4.0 | ○ | Inv. |
| 3-10 | G-6 | C-50 | J | 5.0 | ○ | 1.4 | 58.1 | — | 3.8 | ○ | Inv. |
| 3-11 | H-1-1 | C-50 | K | 5.3 | ○ | — | — | ○ | 5.0 | ○ | Inv. |
| 3-12 | H-1-1 | C-50 | J | 5.0 | ○ | 1.5 | 60.0 | — | 4.3 | ○ | Inv. |
| 3-13 | H-1-2 | C-50 | K | 5.5 | ○ | — | — | ○ | 4.8 | ○ | Inv. |
| 3-14 | H-1-2 | C-50 | J | 5.3 | ○ | 1.5 | 57.6 | — | 4.4 | ○ | Inv. |
| 3-15 | H-1-3 | C-50 | K | 6.7 | ○ | — | — | ○ | 4.6 | ○ | Inv. |
| 3-16 | H-1-3 | C-50 | J | 6.3 | ○ | 2.1 | 58.6 | — | 4.3 | ○ | Inv. |
| 3-17 | H-2-4 | C-50 | K | 6.8 | ○ | — | — | ○ | 4.3 | ○ | Inv. |
| 3-18 | H-2-4 | C-50 | J | 6.2 | ○ | 2.2 | 59.2 | — | 4.1 | ○ | Inv. |
| 3-19 | H-3-4 | C-50 | K | 6.5 | ○ | — | — | ○ | 4.5 | ○ | Inv. |
| 3-20 | H-3-4 | C-50 | J | 6.4 | ○ | 2.3 | 58.6. | — | 4.1 | ○ | Inv. |
| 3-21 | H-3-6 | C-50 | K | 6.8 | ○ | — | — | ○ | 4.6 | ○ | Inv. |
| 3-22 | H-3-6 | C-50 | J | 6.3 | ○ | 2.4 | 59.1 | — | 4.2 | ○ | Inv. |
| 3-23 | H-3-7 | C-50 | K | 6.2 | ○ | — | — | ○ | 4.7 | ○ | Inv. |
| 3-24 | H-3-7 | C-50 | J | 5.8 | ○ | 2.3 | 60.0 | — | 4.2 | ○ | Inv. |
| 3-25 | A-1 | C-50 | K | 6.4 | ○ | — | — | ○ | 4.5 | ○ | Inv. |
| 3-26 | A-1 | C-50 | J | 6.0 | ○ | 1.8 | 59.7 | — | 4.0 | ○ | Inv. |
| 3-27 | A-2 | C-50 | K | 6.0 | ○ | — | — | ○ | 4.2 | ○ | Inv. |
| 3-28 | A-2 | C-50 | J | 5.8 | ○ | 1.9 | 57.7 | — | 4.0 | ○ | Inv. |
| 3-29 | A-3 | C-50 | K | 6.9 | ○ | — | — | ○ | 3.9 | ○ | Inv. |
| 3-30 | A-3 | C-50 | J | 6.6 | ○ | 2.0 | 58.6 | — | 3.8 | ○ | Inv. |
| 3-31 | A-5 | C-50 | K | 6.7 | ○ | — | — | ○ | 4.1 | ○ | Inv. |
| 3-32 | A-5 | C-50 | J | 6.4 | ○ | 2.3 | 57.1 | — | 4.0 | ○ | Inv. |

Comp.: Comparative, Inv.: Invention

As is apparent from the above, the solid processing composition which contains a compound represented by Formula (G), a compound represented by Formula (H-1) through (H-3) or a hexamethylenetetraamine compound is slightly larger in reduction rate of each compound after storage as compared with the solid processing composition which contains a compound represented by Formula (I), but the former is substantially the same as the latter in other evaluation items and the invention is sufficiently effected.

Example 5

Granule sample and tablet sample were prepared in the same manner as in Experiment Nos. 1–51 through 1–74 of Example 1, except that a compound represented by Formula G-5, G-6, H-1-1, H-2-4, H-3-7 or A-1 was used instead of a compound represented by Formula (I-3). The above obtained samples were evaluated in the same manner as in Example 1.

As a result, reduction rate of magenta density was deteriorated by 0.7–1.3%, hardness of tablets by 5–10 kg, and expansion of diameter by 0.2–0.5%, as compared with the results of Experiment Nos. 1–51 through 1–74. However, other evaluation items were substantially the same as the results of Experiment Nos. 1–51 through 1–74 and therefore, the invention is sufficiently effected.

Example 6

Granule sample and tablet sample were prepared in the same manner as in Example 2, except that a compound represented by Formula G-5, G-6, H-1-1, H-2-4, H-3-7 or A-1 was used instead of a compound represented by Formula (I-3). The above obtained samples were evaluated in the same manner as in Example 2.

As a result, hardness after storage was deteriorated by 5–10 kg and expansion of diameter by 0.3–0.8%, as compared with the results of Example 2. However, other evaluation items were substantially the same as the results of Example 2 and therefore, the invention is sufficiently effected.

What is claimed is:

1. A solid processing composition for processing an exposed silver halide photographic light-sensitive material, wherein the composition comprises a) a first compound represented by the following Formula (I) in an amount of 40 to 90 weight %:

Formulas (I)

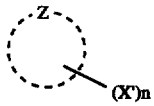

wherein Z represents an atomic group necessary to form a hydrocarbon ring or a heterocyclic ring; X' represents an aldehyde group,

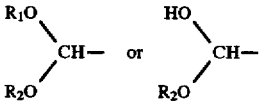

in which $R_1$ and $R_2$ independently represent a lower alkyl group; and n is an integer of 1 to 4 b) a saccharide selected from the group consisting of α-cyclodextrin, β-cyclodextrin and γ-cyclodextrin in an amount of 2.5 to 25.0 weight % and c) a second compound represented by the following Formula (K-I), (K-II), (K-III), (K-IV), (K-V), (K-VI), (K-VII), (K-VIII) or (K-IX) in an amount of 2.5 to 25.0 weight %:

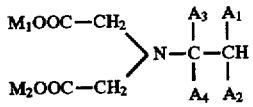

Formula (K-I)

wherein $A_1$, $A_2$, $A_3$ and $A_4$ independently represent a hydrogen atom, a hydroxy group, —COOM', —$PO_3(M_1)_2$, —$CH_2COOM_2$, —$CH_2OH$ or a lower alkyl group which may have a substituent, provided that one of $A_1$ through $A_4$ represents —COOM', —$PO_3(M_1)_2$ or —$CH_2COOM_2$; and M', $M_1$ and $M_2$ independently represent a hydrogen atom, an ammonium group, an alkali metal atom or an organic ammonium group,

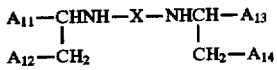

Formula (K-II)

wherein $A_{11}$, $A_{12}$, $A_{13}$ and $A_{14}$ independently represent —$CH_2OH$, —$COOM^3$ or —$PO_3(M^4)_2$ in which $M^3$ and $M^4$ independently represent a hydrogen atom, an ammonium group, an alkali metal atom or an organic ammonium group; X represents an alkylene group having 2 to 6 carbon atoms or —$(B_1O)_{n2}$—$B_2$— in which $n^2$ is an integer of 1 to 8 and $B_1$ and $B_2$ may be the same as or different from each other and independently represent an alkylene group having 1 to 5 carbon atoms,

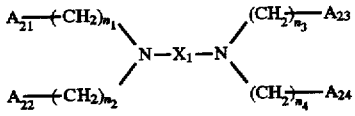

Formula (K-III)

wherein $A_{21}$, $A_{22}$, $A_{23}$ and $A_{24}$ independently represent —$CH_2OH$, —$COOM_5$, —$N[(CH_2)_{n_5}COOH][(CH_2)_{n_6}COOH]$ or —$PO_3(M_6)_2$ in which $M_5$ and $M_6$ independently represent a hydrogen atom, an ammonium group, an alkali metal atom or an organic ammonium group; $X_1$ represents a straight-chained or branched alkylene group having 2 to 6 carbon atoms, a saturated or unsaturated organic ring or —$(B_{11}O)_{n_7}$—$B_{12}$— in which $n_7$ represents an integer of 1 to 8, and $B_{11}$ and $B_{12}$ independently represent an alkylene group; and $n_1$ through $n_6$ independently represent an integer of 1 to 4,

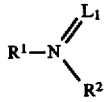

Formula (K-IV)

wherein $R^1$ and $R^2$ independently represent a hydrogen atom, a substituted or unsubstituted alkyl or aryl group; and $L_1$ represents,

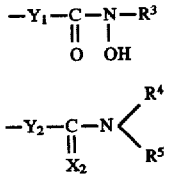

or

-continued

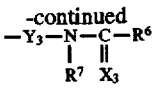

wherein $Y_1$, $Y_2$ and $Y_3$ independently represent an alkylene or arylene group, $X_2$ and $X_3$ independently represent an oxygen atom or a sulfur atom, and $R^3$, $R^4$, $R^5$, $R^6$ and $R^7$ independently represent a hydrogen atom, an alkyl group or an aryl group,

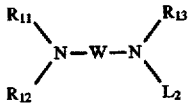

Formula (K-V)

wherein $R_{11}$, $R_{12}$ and $R_{13}$ independently represent a hydrogen atom, a substituted or unsubstituted alkyl or aryl group; $L_2$ represents,

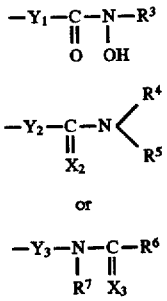

wherein $Y_1$, $Y_2$ and $Y_3$ independently represent an alkylene or arylene group, $X_2$ and $X_3$ independently represent an oxygen atom or a sulfur atom, and $R^3$, $R^4$, $R^5$, $R^6$ and $R^7$ independently represent a hydrogen atom, an alkyl group or an aryl group; and W represents a divalent linking group,

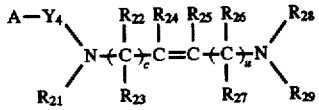

Formula (K-VI)

wherein $R_{21}$, $R_{22}$, $R_{23}$, $R_{26}$, $R_{27}$, $R_{28}$ and $R_{29}$ independently represent a hydrogen atom or a substituted or unsubstituted alkyl or aryl group; $R_{24}$ and $R_{25}$ independently represent a hydrogen atom, a halogen atom, a cyano group, a nitro group, an acyl group, a sulfamoyl group, a carbamoyl group, an alkoxycarbonyl group, an aryloxycarbonyl group, a sulfonyl group, a sulfinyl group or a substituted or unsubstituted alkyl or aryl group, provided that $R_{24}$ and $R_{25}$ may combine to form a 5-membered or 6-membered ring; A represents a carboxy group, a phosphono group, a sulfo group, a hydroxy group or an alkyl metal salt or ammonium salt thereof; $Y_4$ represents an alkylene group or an arylene group which may have a substituent; and t and u are each an integer of 0 or 1,

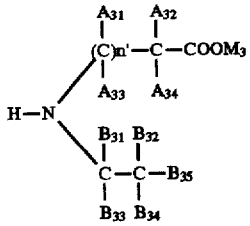

Formula (K-VII)

wherein n' is an integer of 1 to 3; $A_{31}$, $A_{32}$, $A_{33}$ and $A_{34}$, and $B_{31}$, $B_{32}$, $B_{33}$, $B_{34}$ and $B_{35}$ independently represent —H, —OH, $—C_{n''}H_{2n''+1}$, or $—(CH_2)_{m_1}X_5$ in which n" and $m_1$ are an integer of 1 to 3 and an integer of 0 to 3, respectively, and $X_5$ represents $—COOM_3$ (in which $M_3$ represents a hydrogen atom, an ammonium group or an alkali metal atom), $—N_2$ or —OH, provided that $B_{31}$ through $B_{35}$ are not simultaneously hydrogen atoms, Formula (K-VIII)

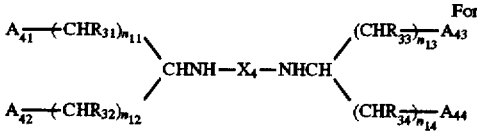

wherein $A_{41}$, $A_{42}$, $A_{43}$ and $A_{44}$ independently represent $—COOM_{21}$, —OH, $—PO_3(M_{21})$ $(M_{22})$ or $—CONH_2$ in which $M_{21}$ and $M_{22}$ independently represent a hydrogen atom, an alkali metal atom or an ammonium group; $n_{11}$, $n_{12}$, $n_{13}$ and $n_{14}$ independently represent 0, 1 or 2; $R_{31}$, $R_{32}$, $R_{33}$ and $R_{34}$ independently represent a hydrogen atom, a lower alkyl group or a hydroxy group, provided that when $n_{11}+n_{12}=1$ and $n_{13}+n_{14}=1$, none of $R_{31}$, $R_{32}$, $R_{33}$ and $R_{34}$ are hydrogen atoms; and $X_4$ represents a substituted or unsubstituted alkylene group having 2 to 6 carbon atoms or $—(B_{21}O)_{m_{11}}—B_{22}—$ in which $m_{11}$ is an integer of 1 to 4 and $B_{21}$ and $B_{22}$ independently represent a substituted or unsubstituted alkylene group having 1 to 5 carbon atoms, Formula (K-IX)

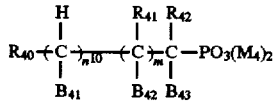

wherein $R_{40}$, $R_{41}$ and $R_{42}$ independently represent a hydrogen atom, —OH, a substituted or unsubstituted lower alkyl group; $B_{41}$, $B_{42}$ and $B_{43}$ independently represent a hydrogen atom, —OH, $—COOM_7$, $—PO_3(M_8)_2$ or $—N(R')_2$ in which R' represents a hydrogen atom, an alkyl group having 1 to 5 carbon atoms or $—PO_3(M_8)_2$; $M_4$, $M_7$, and $M_8$ independently represent a hydrogen atom or an alkali metal atom; and $n^{10}$ and m independently represent an integer of 0 or 1.

2. The solid processing composition of claim 1, wherein said second compound is represented by said Formula (K-III).

3. The solid processing composition of claim 1, wherein said saccharide is β-cyclodextrin.

4. The solid processing composition of claim 1, wherein Z in said Formula (I) is a benzene ring.

5. The solid processing composition of claim 1, wherein the composition is a composition for a stabilizer.

6. The solid processing composition of claim 1, further comprising a fluorine-containing anionic surfactant represented by the following Formula (D):

$$Rf—(X)_{m_{21}}(Y)_{n_{21}}—A \qquad \text{Formula (D)}$$

wherein Rf represents a saturated or unsaturated aliphatic group; X represents a sulfonamide group,

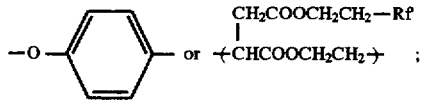

in which Rf' represents a saturated or unsaturated fluorine containing hydrocarbon group; Y represents an alkyleneoxy or alkylene group; A represents $—SO_3M"$, $—OSO_3M"$, —COOM", $—OPO_3(M_1")$ $(M_2")$ or $—PO_3(M_1")$ $(M_2")$, in which M", $M_1"$ and $M_2"$ independently represent H, Li, K, Na or $NH_4$; $m_{21}$ represents 0 or 1; and $n_{21}$ represents an integer of 0 to 10.

7. The solid processing composition of claim 1, wherein the content of the first compound in the solid processing composition is 10 to 90 weight %.

8. The solid processing composition of claim 1, wherein the composition is in the form of granules or tablets.

* * * * *